US005564691A

United States Patent [19]

Hatamachi et al.

[11] Patent Number: 5,564,691

[45] Date of Patent: Oct. 15, 1996

[54] BILL PROCESSOR

[75] Inventors: Tadashi Hatamachi, Tsurugashima; Toshihiko Kasuya, Tokorozawa; Yasuyuki Kodama, Ageo; Makoto Yamamoto, Sayama; Mitsugu Mikami, Kawagoe; Yukichi Hayashi, Sakado, all of Japan

[73] Assignee: Kabushiki Kaisha Nippon Conlux, Japan

[21] Appl. No.: 330,207

[22] Filed: Oct. 27, 1994

[30] Foreign Application Priority Data

Nov. 5, 1993 [JP] Japan ..... 5-276592

[51] Int. Cl.[6] ..... B65H 29/44

[52] U.S. Cl. ..... 271/178; 271/181

[58] Field of Search ..... 271/177, 178, 271/180, 181, 220, 315

[56] References Cited

U.S. PATENT DOCUMENTS

| | | | |
|---|---|---|---|
| 3,485,358 | 12/1969 | Hooker . | |
| 3,924,847 | 12/1975 | Pescetto . | |
| 3,937,926 | 2/1976 | Jones et al. . | |
| 3,966,047 | 6/1976 | Steiner . | |
| 4,045,017 | 8/1977 | Lundblad . | |
| 4,091,271 | 5/1978 | Jones et al. . | |
| 4,283,708 | 8/1981 | Lee . | |
| 4,348,656 | 9/1982 | Gorgone et al. . | |
| 4,470,496 | 9/1984 | Steiner . | |
| 4,512,263 | 4/1985 | Lanning | 271/180 X |
| 4,513,439 | 4/1985 | Gorgone et al. . | |
| 4,513,880 | 4/1985 | Mori et al. . | |
| 4,540,081 | 9/1985 | Mori et al. . | |
| 4,556,139 | 12/1985 | Akagawa et al. . | |
| 4,678,072 | 7/1987 | Kobayashi et al. . | |
| 4,731,523 | 3/1988 | Kozima . | |
| 4,749,076 | 6/1988 | Akagawa et al. . | |
| 4,765,607 | 8/1988 | Zouzoulas . | |
| 4,775,824 | 10/1988 | Barnes et al. . | |
| 4,784,274 | 11/1988 | Mori et al. . | |
| 4,807,736 | 2/1989 | Kondo et al. . | |
| 4,809,966 | 3/1989 | Kobayashi et al. . | |
| 4,858,744 | 8/1989 | Dolejs et al. . | |
| 4,880,096 | 11/1989 | Kobayashi et al. . | |
| 5,195,739 | 3/1993 | Watabe . | |
| 5,209,335 | 5/1993 | Shuren et al. . | |
| 5,209,395 | 5/1993 | Zouzoulas et al. . | |
| 5,222,584 | 6/1993 | Zouzoulas . | |
| 5,254,841 | 10/1993 | Watabe et al. . | |
| 5,286,017 | 2/1994 | Hawk et al. | 271/180 X |

FOREIGN PATENT DOCUMENTS

| | | | |
|---|---|---|---|
| 3288762 | 12/1991 | Japan | 271/178 |
| 6166457 | 6/1994 | Japan | 271/178 |

*Primary Examiner*—David H. Bollinger
*Attorney, Agent, or Firm*—Greer, Burns & Crain, Ltd.

[57] ABSTRACT

A bill processor for use in a bill handling machine comprises a first bill transport passage for guiding a bill inserted in a direction substantially perpendicular to the longitudinal direction of bills stacked in a stacker toward substantially middle of interior of the main body of the bill handling machine, and a second bill transport passage for guiding the bill from the termination end of the first bill transport passage along the longitudinal direction of the stacked bills, wherein the first bill transport passage is formed in a meandering form along the longitudinal direction of the stacked bills, whereby the depth of the bill processor can be made small.

7 Claims, 29 Drawing Sheets

BILL PROCESSOR

BACKGROUND OF THE INVENTION

1. Field of the Invention

The present invention relates to a bill processor which is used in vending machines, money changing machines, game token exchange machines, etc.

2. Description of the Related Art

A bill handling machine such as a vending machine includes a bill processor for judging whether inserted bills are genuine or not and for accommodating only the bills judged as genuine.

Such a bill processor generally comprises a bill transport passage for guiding bills inserted through a bill insert slot to the main body of the machine, bill judging means for judging whether the transported bills are genuine or not, and a bill stacking mechanism for sequentially pushing the bills judged as genuine into a stacker to stack them therein.

FIG. 33 is a partially broken-away view of a conventional bill processor in which the bill processor 1 includes a main body 2 which is formed into a generally inverted L shape as viewed from its side. The main body 2 is formed at its upper left end with a bill insert slot 3. The bill insert slot 3 is arranged such as to be mounted to a door (not shown) which forms a front side of the bill handling machine and through which a fore end of the bill insert slot 3 is exposed externally.

Provided immediately downstream of the bill insert slot 3 is a first horizontal bill transport passage 4 which guides a bill inserted through the bill insert slot 3 to a rightward direction of the drawing. Disposed in the middle of the first bill transport passage 4 is a bill transport means 8 which includes a transport belt 5 and follower rollers 6 and 7 which are brought into pressing contact with the transport belt 5. A bill judging means 19 such as a magnetic sensor or a photo sensor is disposed along the first horizontal bill transport passage 4, and judges whether the bill is genuine or not.

In the operation of the bill processor 1, when a bill is inserted through the bill insert slot 3, a bill detection sensor (not shown) disposed in the bill insert slot 3 detects the presence or absence of the inserted bill and generates a detection signal in response to the presence of the bill. The detection signal causes the transport belt 5 to be forwardly rotated in the counterclockwise direction, whereby the inserted bill is horizontally transported in the rightward direction along the first bill transport passage 4.

The inserted bill transported to the rightward direction by the transport belt 5 eventually reaches the bill judging means 19 located approximately midway of the transport belt 5, where the bill is judged whether it is genuine or not.

When the inserted bill is judged as false by the bill judging means 19, the transport belt 5 is rotated reversely (in the clockwise direction) in response to a signal outputted from the bill judging means 19 so that it is returned to the bill insert slot 3.

When the bill judging means 19 judges that the inserted bill is genuine, the transport belt 5 is kept rotated forwardly so that the inserted bill is further transported horizontally in the right direction along the first bill transport passage 4. Then, the bill is transported downward along a second bill transport passage 9 which is disposed around the middle of the main body 2 vertically and downwardly with substantially 90 degrees with respect to the first bill transport passage 4.

In the second bill transport passage 9, a second transport belt 10 is disposed. The second transport belt 10 rotates in the clockwise direction by following the forward rotation of the transport belt 5. Thus, the fore end of the inserted bill judged to be genuine is eventually transported into a lower side of a stacker 11.

Further provided in the second bill transport passage 9 is a bill stacking mechanism 12 which acts to sequentially push the inserted bill judged as genuine into the stacker 11.

The bill stacking mechanism 12 includes a link mechanism 13 of a pantagraph structure which functions, when the inserted bill judged as genuine is guided down to a predetermined position of the stacker 11 along the second bill transport passage 9, to reciprocatively move in the rightward direction of the drawing to stack the genuine bills in the stacker 11 one over another, as shown in FIG. 34.

In this connection, when a full state of the stacker 11 in which bills are fully stacked in the stacker 11, is detected by a stacker-full sensor (not shown), a money collecting person collects the fully-stacked bills from the stacker 11.

In the conventional bill processor 1 as shown in FIG. 33, the money collecting person releases the engagement between the main body 2 and stacker 11 by means of a latch means (not shown), turns an upper cover of the stacker 11 in the clockwise direction around a shaft G provided at a lower end of the stacker 11 to open the upper cover, and then draws upward a bundle of the bills which is sometimes called bill bundle in this specification (although bills are not bound tied together) stacked in the stacker 11.

Although omitted in the bill processor 1 of FIG. 33 to simplify the description, a shutter for opening and closing the first bill transport passage 4 is disposed at a downstream side of the bill insert slot 3.

The shutter 14, as shown in FIG. 35 by a partially broken-away perspective view of a part of the machine of FIG. 33, comprises upper and lower chutes 15 and 16 defining the first bill transport passage 4, slits **15*a* and 16*a* formed in the upper and lower chutes 15 and 16 in the traversing direction of the chutes, and a plate 17 slidable vertically relative to the slits 15*a* and 16*a*** by a motor and a rack/pinion mechanism (both not shown).

The shutter 14 may be disposed immediately downstream of the bill insert slot 3 or between the first bill transport passage 4 and second bill transport passage 9. Description will be made for the structure in which the shutter 14 is disposed immediately downstream of the bill insert slot 3.

When the bill judging means 19 judges that the inserted bill transported along the first bill transport passage 4 is genuine, the shutter 14 is operated to prevent the inserted bill from being illegally pulled out by a user. More particularly, when the inserted bill passes toward the downstream side of the shutter 14, the plate 17 is moved downward by a predetermined distance by means of a motor (not shown) through a rack/pinion mechanism, and is passed through the slits **15*a* and 16*a* to close the passage defined between the upper and lower chutes 15 and 16. When the inserted bill is accommodated in the stacker, the plate 17 is moved upward to open the passage defined between the upper and lower chutes 15 and 16**.

In the bill processor 1, the inserted bill can be sequentially accommodated in the stacker until the number of exceeds the capacity of the stacker. When the number of the stacked bills exceeds the allowable range, a subsequent bill is rejected.

To this end, in the conventional bill processor 1 shown in FIG. 33, there is provided a stacker-full detection switch for detecting the fully-stacked state of the stacker, which comprises photo sensors.

More specifically, in the bill processor 1, a light emitting element and a light receiving element (both not shown) are disposed at both sides of the stacker 11 as spaced from each other by a predetermined distance. When the number of stacked bills is increased until a part of a tray 13*a* receiving the stacked bills interrupts a passage between the aforementioned two elements, judgement is made that the stacker is full of bills.

Meanwhile, there has recently been a demand to make thinner the depth of a vending machine so as to prevent protrusion of the vending machine into a public space such as a pavement. To meet the demand, the bill processor that is mounted in the vending machine should be made thinner.

For this purpose, it is necessary to shorten the length L of the first bill transport passage 4 of FIG. 33 which ranges from the tip end of the bill insert slot 3 to the end (start end of the second bill transport passage 9) of the first bill transport passage 4. However, the shortening of the first bill transport passage causes a problem since various devices including the bill judging means 19 must be installed along the first bill transport passage. Therefore, it is impossible to shorten a length L of the first bill transport passage 4 to a large extent. As a result, it is difficult to decrease the dimension M of the bill processor 1 in its depth direction and correspondingly to make thinner the depth of the bill handling machine.

Further, the conventional bill processor 1 has another problem that since the bill judging means 19 is horizontally disposed along the first horizontal bill transport passage 4, foreign matters such as dust tend to deposit on the detection surfaces of the respective sensors during passage of the bill, which leads to incorrect judgement of the inserted bill as to the genuineness of the bill. In order to maintain the performance of the bill judging means 19, it is necessary to disassemble the machine at a frequent interval so as to clean the detection surfaces of the sensors, which increases troublesome maintenance works.

Furthermore, the conventional bill processor 1 is defective in that since bills are merely sequentially stacked in the stacker 11 one over another, when it is desired for the money collecting person to collect the bills from the stacker 11, the tends to be scattered, requiring careful collecting work.

Still another problem of the conventional bill processor 1 is that, since the width of the slits 15*a* and 16*a* of the shutter 14 (FIG. 31) through which the plate 17 passed is wider than the width of a bill 18 being transported, when the bill 18 is curled at its end, the curled end of the bill tends to go into the slit 16*a* (or 15*a*) as shown by the cross-sectional view of the major part of FIG. 35, which results in bill jamming.

In addition, in the conventional bill processor 1, the light emitting element and the light receiving element are disposed at the both sides of the stacker 11 as spaced from each other by the predetermined distance in order to detect that full state of the stacker 11. This means that separated optical parts such as the photo sensors and a space for mounting of these parts are required, which increases the number of steps for assembling the processor, the dimension of the stacker and the production cost of the stacker.

SUMMARY OF THE INVENTION

It is accordingly that the first object of the present invention is to provide a bill processor having a small dimension in the depth direction.

The first object is attained by the bill processor of the first aspect of the present invention, which comprises a first bill transport passage for guiding a bill inserted in a direction substantially perpendicular to a longitudinal direction of the stacked bills in a stacker toward substantially middle of interior of a main body of the bill processor, and a second bill transport passage for guiding the inserted bill from a termination end of the first bill transport passage along the longitudinal direction of the stacked bills in the stacker, wherein the first bill transport passage is formed in a meandering manner along the longitudinal direction of the stacked bills in the stacker.

In the bill processor in accordance with the first aspect of the present invention, since the first bill transport passage is formed in a meandering manner along the longitudinal direction of the bills stacked in the stacker, the distance of the first bill transport passage in the depth direction from the bill insert slot to the start end of the second bill transport passage can be reduced without shortening the full length of the first bill transport passage.

The second object of the present invention is to provide a bill processor having a small depth and minimizing deposition of foreign matters such as dust on the detection surfaces of respective sensors.

In accordance with the second aspect of the present invention, the above object is attained by providing a bill processor which comprises a bill transport passage for guiding an inserted bill to a stacker provided in a main body of the bill processor, and bill judging means disposed along the bill transport passage, wherein the bill transport passage includes at least one vertical portion for transporting the inserted bill upward or downward and the bill judging means is provided along the vertical portion.

In the bill processor in accordance with the second aspect of the present invention, since the bill transport passage in the meandering form includes at least one vertically rising or falling part, the distance of the bill transport passage in the depth direction from the bill insert slot to the termination end of the bill transport passage can be reduced. Further, since the bill judging means is provided at the rising or falling part, it is vertically provided in the bill transport passage. Therefore, dust or the like carried from the outside of the processor during passage of the bill and falls downward by gravity cannot be deposited on the detection surfaces of the respective sensors.

The third object of the present invention is to provide a bill processor in which stacked bills in the stacker can be easily collected by an authorized money collecting person of a vending machine incorporating the processor.

In accordance with the third aspect of the present invention, the above object is attained by providing a bill processor which comprises a bill transport passage for guiding an inserted bill into the main body of the bill processor, and stacker for stacking therein the bill transported through the bill transport passage, wherein bill restraint means are provided at both sides of the stacker for partly restraining the at their both sides when the stacker is released from the main body and for releasing the restraint of the bills stacked the stacker when the stacker is mounted to the main body.

In the bill processor in accordance with the third aspect of the present invention, since the bills stacked in the stacker are not subjected to any restraint when the stacker is mounted to the main body while the bills are subjected to partial restraint at their both sides by the bill restraint means, they can be held in an aligned form (bundle) in the stacker.

Accordingly, the money collecting person can easily pull out the bill bundle from the top of the stacker.

The fourth object of the present invention is to provide a bill processor which can prevent an inserted bill from being caught by a slit to thereby minimize or suppress possible generation of bill jamming or clogging.

In accordance with the fourth aspect of the present invention, the above object is attained by providing a bill processor which comprises a bill transport passage for guiding an inserted bill into a main body of the bill processor, and shutter for opening and closing the bill transport passage, wherein the shutter includes a plurality of plates each disposed in a non-aligning manner with each other along a traversing direction of the bill transport passage and a plurality of openings each having a shape corresponding to sectional shape of associated one of the plurality of plates.

In the bill processor in accordance with the fourth aspect of the present invention, since the plurality of shutter plates are provided in a zigzag form along the traversing direction of the bill transport passage and the plurality of openings corresponding in sectional shape to the shutter plates are formed, it will not occur that the tip end of the bill is caught in the openings during the passage of the bill through the bill transport passage. Even if the tip end of the bill is caught by the openings, since each opening is smaller than the bill, the bill cannot enter the openings and therefore possible generation of bill clogging or jamming can be prevented.

The fifth object of the present invention is to provide a bill processor which can detect a state of the stacker stacked with bills (i.e., a stacker-full state) without causing increase of size of the stacker and increase of the cost.

In the bill processor in accordance with the fifth aspect of the present invention, the above object is attained by providing a bill processor which comprises a bill transport passage for guiding an inserted bill into a main body of the bill processor, a stacker provided in the main body for stacking therein the bill transported through the bill transport passage, bill guide drums rotatably disposed at both sides of the stacker in its width direction for guiding the bill to be stacked in the stacker, drive means for synchronously rotating the bill guide drums, and a bill pushing plate engaged with the bill guide drums for pushing the bill toward the stacker in accordance with the rotation of the bill guide drums, wherein stacker-full detection means is provided for detecting that the stacker is fully stacked with bills on the basis of a load output of the drive means when the bill pushing plate pushes the bill toward the stacker.

In the bill processor in accordance with the fifth aspect of the present invention, bills guided to the stacker through the bill transport passage are sequentially stacked in the stacker by the bill guide drums one after another. At this time, the bill pushing plate is raised in response to the rotation of the bill guide drums to push the bill into the stacker. The bill pushing plate is always moved up to the predetermined position of the stacker side to push the bill so that, as the bill is stacked in the stacker, the bill pushing plate is moved against the thickness of the stacked bills and thus the load of the drive means for rotating the bill guide drums is correspondingly increased. Accordingly, when the bill processor is arranged so that a load of the drive means at the time of the stacker-full state is previously held as a stacker-full load, the then load of the drive means is measured, and it is judged that the stacker is fully stacked with bills when the then load exceeds the stacker-full load; the bill processor can detect the stacker-full state. With this arrangement, the stacker-full state can be detected with a simple arrangement in which only an electrical connection is required in an existing bill processor. Therefore, optical parts such as a photo sensor are not unnecessary and the space for mounting of such optical parts to the main body as well as the works therefor can be eliminated. Thus, the stacker-full state can be detected without causing increase of size of the stacker and increase of the cost.

The sixth object of the present invention is to provide a bill processor which can be made small in the depth of the processor while avoiding deterioration of its bill stacking function.

In accordance with the sixth aspect of the present invention, the above object is attained by providing a bill processor which comprises a bill transport passage for guiding an inserted bill into a main body of the bill processor, a stacker provided in the main body for stacking therein the inserted bill transported through the bill transport passage, bill guide drums rotatably disposed at both sides of the stacker in its width direction for guiding the bill to be stacked in the stacker, and drive means for synchronously rotating the bill guide drums, wherein a bill pushing plate is provided for pushing the bill at its substantially central part toward the stacker in cooperation with the stacking of the bill by the bill guide drums.

In the bill processor in accordance with the sixth aspect of the present invention, when the bill is pushed into the frontmost row of the stacker as the bill guide drums rotate, the bill pushing plate pushes the substantially central part of the bill toward the stacker. Therefore, even when a frictional force takes place between the both sides of the bill and the outer peripheral surfaces of the rotating bill guide drums, the bill is pushed toward the frontmost row of the stacker by the bill pushing plate. Thus, it can be prevented that the bill is caught in the rotating bill guide drums and the bill can be reliably stacked in the stacker.

DESCRIPTION OF THE EMBODIMENTS

A bill processor in accordance with an embodiment of the present invention will be described with reference to the accompanying drawings.

Figure 1:
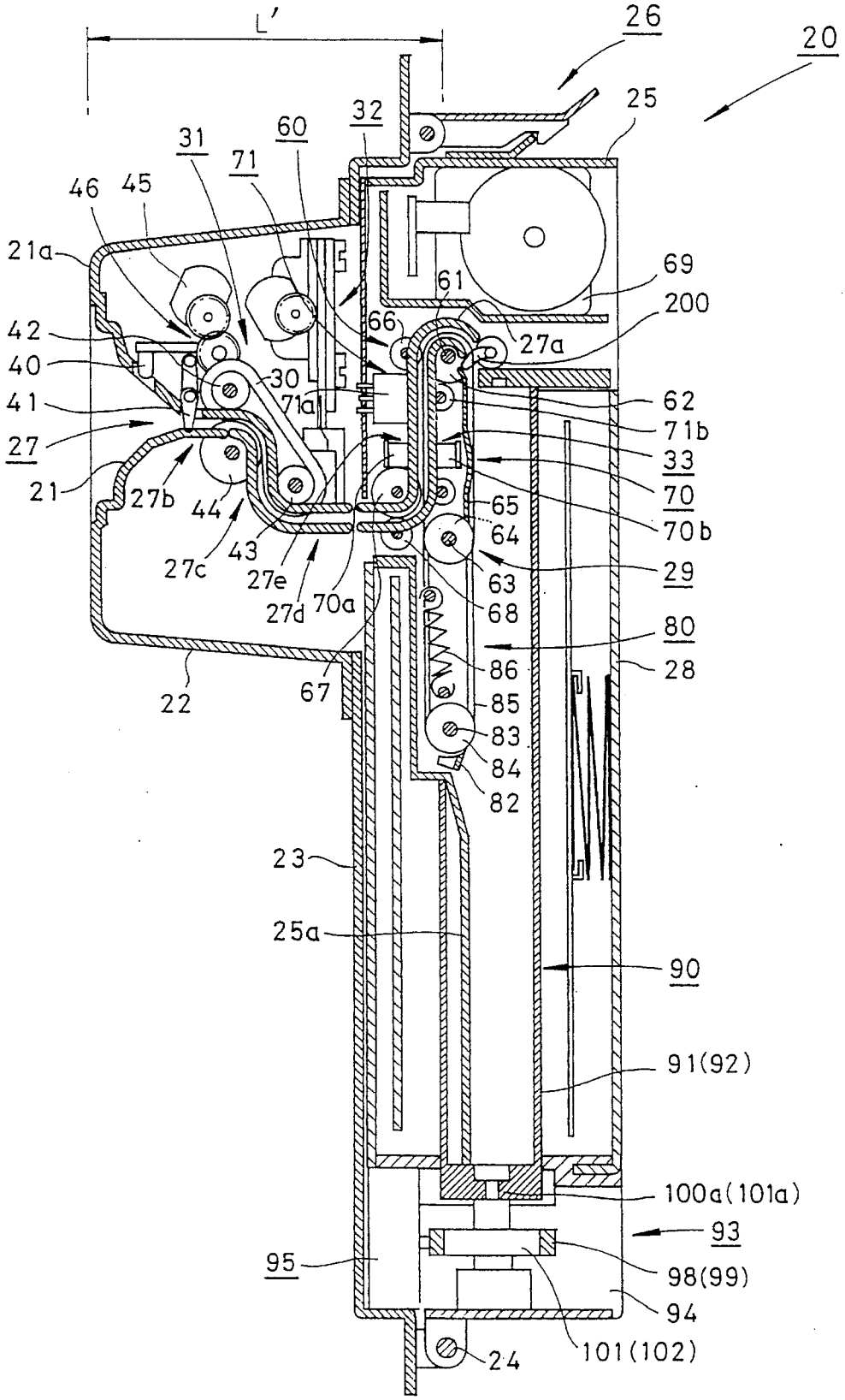
FIG. 1 is a cross-sectional view of a bill processor in accordance with the present invention.

Referring first to FIG. 1, there is shown a cross-sectional view of a bill processor 20 in accordance with an embodiment of the present invention. The bill processor 20 is formed, as in the conventional bill processor, into a generally inverted-L shape as viewed from its side.

The bill processor 20 includes a front plate 23 on which a front mask 22 provided with a bill insert slot 21 is fixedly mounted. It further includes a main body 25 as a casing supported rotatably in the clockwise direction around a shaft 24 provided in a lower end of the front plate 23. The main body 25 is engaged normally to the front plate 23 by means of a latch means 26 disposed at the top of the front plate 23 to restrict rotation of the main body 25.

As in the conventional bill process, in the bill processor 20, the bill insert slot 21*a* is connected to a first bill transport passage 27 for transporting a bill inserted through the bill insert slot 21 up to an intermediate position of the main body 25.

Also provided in the main body 25 is a second bill transport passage. 29 which is connected to a termination end 27*a* of the first bill transport passage 27 to extend downward by an angle of about 90 degrees along the longitudinal direction of the main body 25, i.e., the longitudinal direction of the bills stacked in a stacker 28 which is located on the rear side of the main body 25.

The first bill transport passage 27 is in the form of a generally U shape in a meandering manner along the longitudinal direction (longitudinal direction of the main body 25) of the bills in the stacker 28, as illustrated.

In the upstream side of the first bill transport passage 27 between a horizontal part 27*a* and a falling part 27*c*, a first bill transport means 31 is provided which includes a transport belt 30 in the form of a cocked belt for forcible transport of the inserted bill into the main body 25. Provided at a bottom flat part 27*d* of the first bill transport passage 27 is a shutter 32 for opening and closing the first bill transport passage 27.

In the downstream side of the first bill transport passage 27, provided at an rising part 27*e* is a bill judging means 33 for judging whether the inserted bill is genuine or not.

With the structure of the first bill transport passage 27, since the first bill transport passage 27 is in the form of a generally U shape along the longitudinal direction of the stacked bill in a meandering manner, a depth L' of the bill processor from a tip end 21*a* of the bill insert slot 21 to a start end (corresponding to the termination end 27*a* of the first bill transport passage 27) of the second bill transport passage 29 can be reduced to a large extent, without the need for shortening the full length of the first bill transport passage 27.

Provided in the front mask 22 defining the bill insert slot 21 is, in addition to the first bill transport means 31 and shutter 32, an inlet lever 41 for detecting the leading and trailing ends of the inserted bill. Disposed close to the inlet lever 41 is a photo sensor (not shown) for detecting the inserting and discharging operation of the bill by the inlet lever 41. An illustrated photo sensor 40 is a monitor lamp for informing the user of the operative state of the bill.

The first bill transport means 31 comprises the transport belt 30 wound around a pair of pulleys 42 and 43, a follower roller 44 in pressing contact with the transport belt 30, and a motor 45 for applying a driving force to the transport belt 30, whereby the driving force of the motor 45 is transmitted to the transport belt 30 via a gear transmission mechanism 46 having a plurality of gears.

Figure 2:
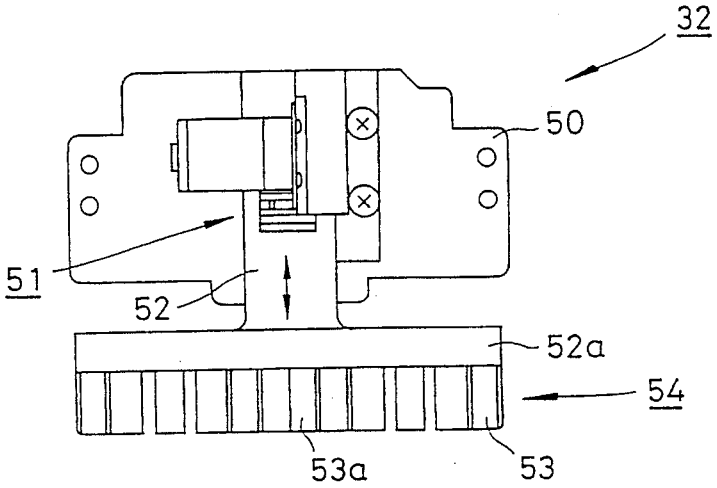
FIG. 2 is a front view of an example of a shutter provided at a bill transport passage in the bill processor.
Figure 3A:
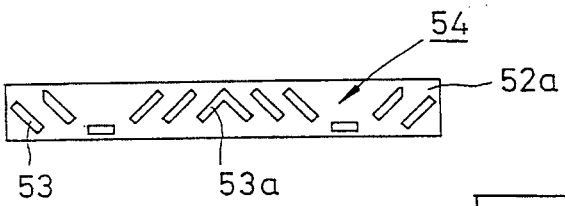
FIGS. 3(*a*) and 3(*b*) show bottom views of the shutter.
Figure 3B:
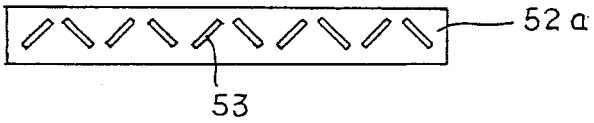

Referring to FIG.2, the shutter 32 includes a first plate 50 fixed to the front mask 22 (see FIG. 1) and a second plate 52 vertically and slidably supported by a rack/pinion mechanism 51 with respect to the first plate 50. The second plate 52 is provided at its lower end 52*a* with a shutter 54 which comprises a plurality of plates 53 embedded into the lower end 52*a* with their mutually different (zigzag) orientations, as shown by its bottom view in FIG. 3(*a*).

Of the plurality of plates 53, the plate 53*a* embedded in the midway position of the lower end 52*a* is formed to have a substantially dogleg-shaped section while the other plates are formed to have a substantially rectangle-shaped section. Further, the orientation of the plates 53 may be embedded in such a manner that the plates in each pair are orientated in mutually different directions (in a zigzag form) as shown, e.g., in FIG. 3(*b*). In other words, the shape and orientation of the plates 53 can be set arbitrarily so long as the plates are positioned alternately inca zigzag form along the first bill transport passage 27 in its traversing direction, and thus the invention is not limited to the specific patterns shown in the embodiment.

It will be appreciated that, since the plurality of plates 53 as the shutter 54 are embedded with their mutually different orientations in the present embodiment, the shutter 54 is covered with the respective plates 53 in the full traversing direction of the shutter 54 substantially without any gaps therebetween when viewed from its front as shown in FIG. 2. Thus, it can be prevented the user illegally draws out the once-inserted bill again from the insert slot.

Figure 4:
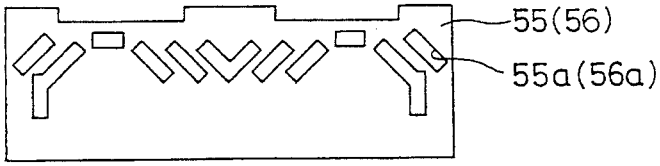
FIG. 4 is a plan view of a part of the transport passage.

As shown in FIG. 4, upper and lower chutes 55 and 56 defining the first bill transport passage 27 (see FIG. 1) located as opposed to the shutter 54 are formed therein with a plurality of holes 55*a* and 56*a* having shapes corresponding to the sectional shapes of the plurality of plates 53, so that the plurality of plates 53 comprised of the shutter 54 can be projected through the corresponding holes.

Detailed description will next be made as to the operation of the shutter 32 as well as the structure thereof.

Figure 5:
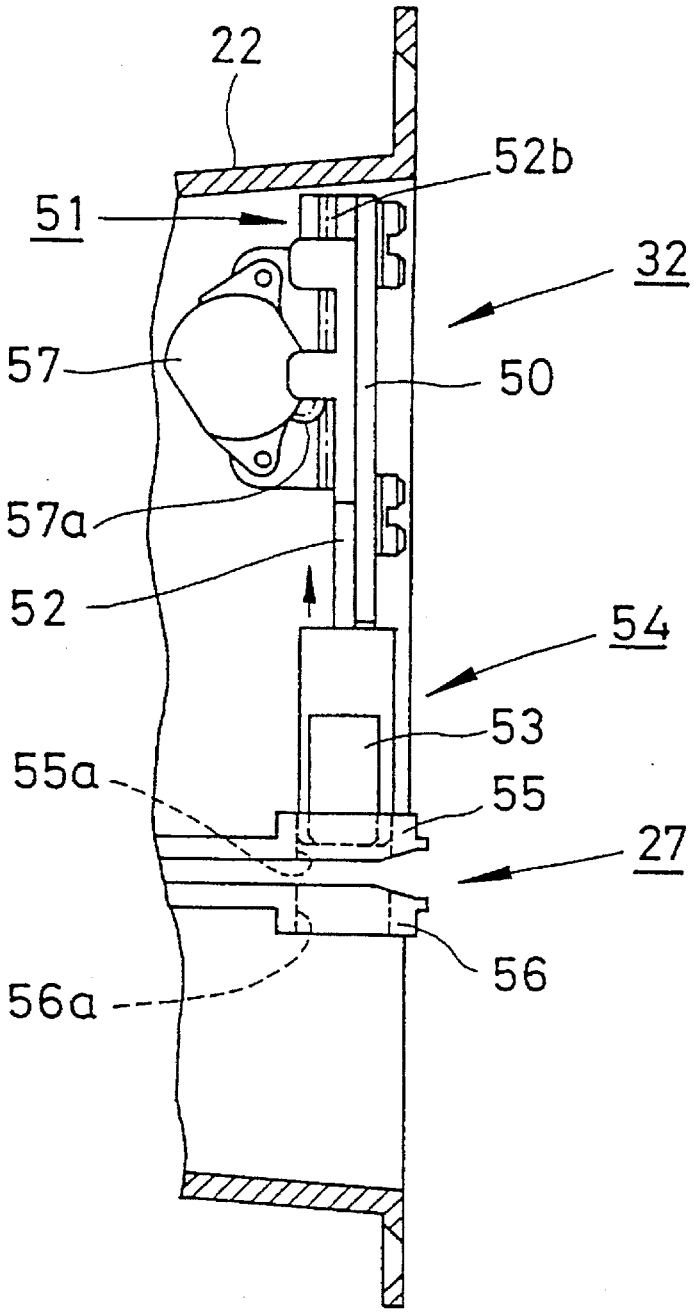
FIG. 5 is a cross-sectional view of the shutter.

As illustrated in FIG. 5 showing an enlarged broken-away view of a major part of FIG. 1, when it is desired to open the first bill transport passage 27, the rack/pinion mechanism 51 including a pinion 57*a* of a shutter motor 57 and a rack 52*b* formed in the second plate 52 and engaged with the pinion 57*a* pulls up the second plate 52 by a predetermined distance to thereby draw the plurality of plates 53 of the shutter 54 provided at the lower end of the second plate 52 out of the holes 56*a* of the lower chute 56, thus opening the first bill transport passage 27 defined between the upper and lower chutes 55 and 56.

Figure 6:
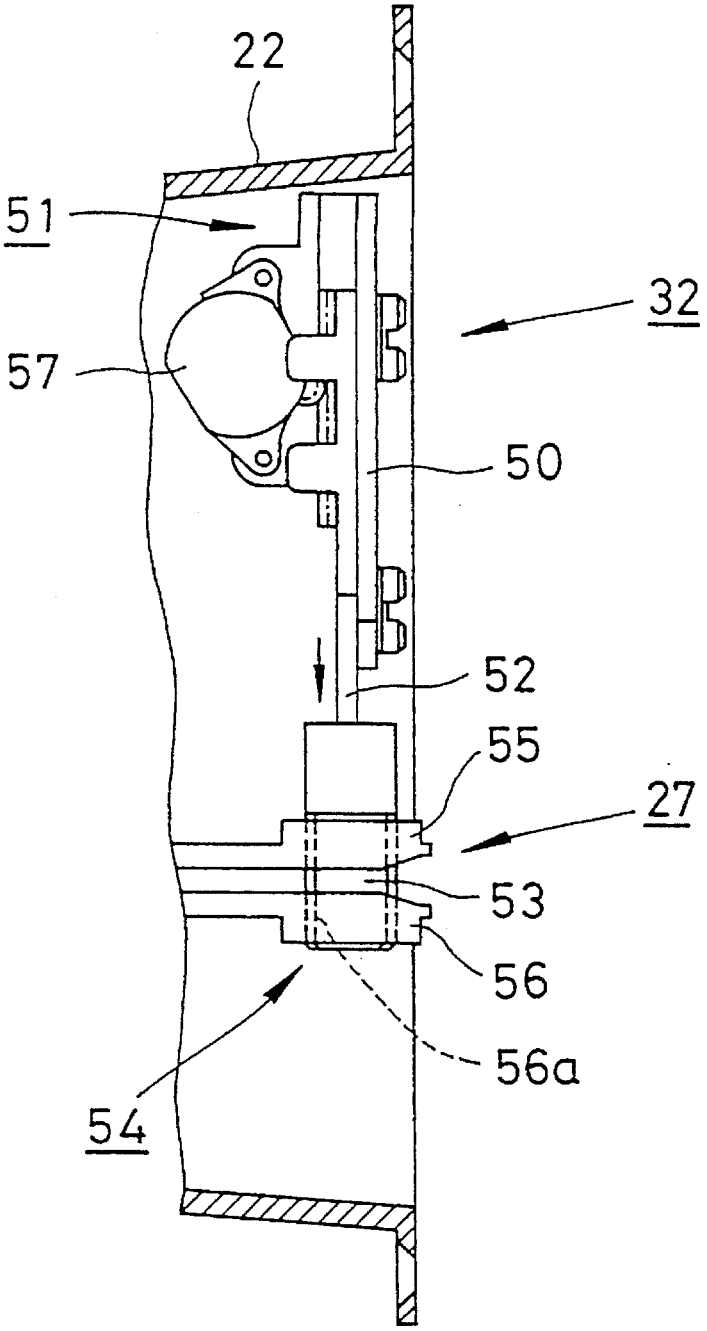
FIG. 6 is a cross-sectional view of the shutter.

When it is desired to close the first bill transport passage 27, on the other hand, as shown in FIG. 6, the driving force of the shutter motor 57 causes the rack/pinion mechanism 51 to pull down downward the second plate 52 by a predetermined distance to thereby fittingly insert the plurality of plates 53 of the shutter 54 provided at the lower end of the second plate 52 into the holes 56*a* of the lower chute 56, thus closing the first bill transport passage 27 defined between the upper and lower chutes 55 and 56.

In the shutter 32, it is only required for the upper and lower chutes 55 and 56 of the first bill transport passage 27 to be opened and closed to be formed therein with the holes 55*a* and 56*a* having widths allowing the plurality of plates 53 of the shutter 54 to be inserted therethrough. In this case, when a bill is passed through a gap defined between the upper and lower chutes 55 and 56 provided with the plurality of holes 55*a* and 56*a*, it becomes difficult for the leading end of the bill to be caught by edges of the holes 55*a* and 56*a* and, even if the bill is caught, the bill will not enter the holes because the surface area of each hole is significantly smaller than that of the bill. As a result, the bill clogging resulting from the tip end of the bill caught by the hole edges can be advantageously effectively prevented or minimized.

In the shutter 32, the driving force of the shutter motor 57 is transmitted to the second plate 52 through the rack/pinion mechanism 51 as shown in FIG. 6 so that the second plate 52 is moved downward by a predetermined distance to close the first bill transport passage 27 defined between the upper and lower chutes 55 and 56. However, the second plate 52 is coupled to the shutter motor 57 through the rack/pinion mechanism 51 having a small reduction ratio when viewed from the side of the motor 57 and having a small frictional force between gears. For this reason, there is a danger that, when the second plate 52 is forcibly pushed upward from its state of closing the first bill transport passage 27 with use of such a tool as a screw driver, this is followed by the rotation of the motor 57, for which reason the second plate 52 may be moved upward to open the first bill transport passage 27.

In order to prevent the movement of the shutter 54 by an external force, it is possible, as the means for transmitting the driving force of the shutter motor 57 to the shutter 54, to replace the rack/pinion mechanism 51 by a gear transmission means including a worm gear and a worm wheel meshed with the worm gear.

Figure 7:
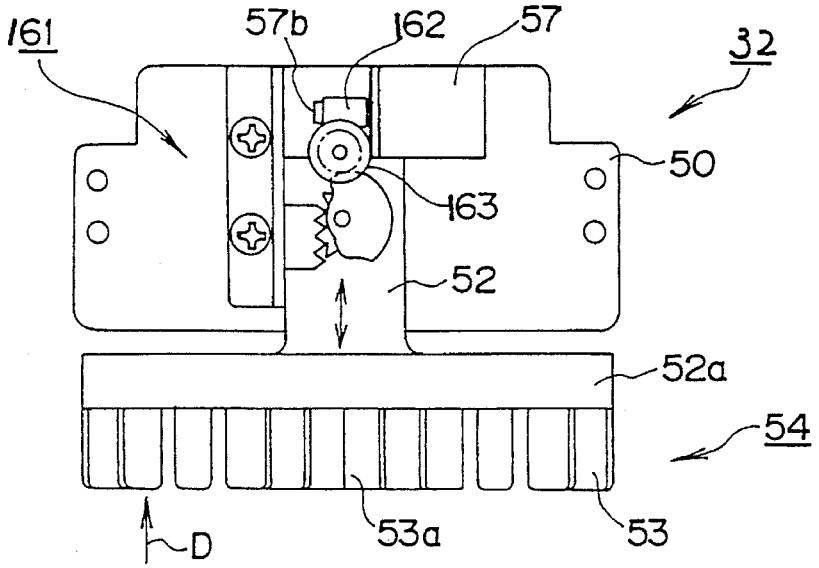
FIG. 7 is a front view of another example of the shutter.

Another example of the shutter 32 is shown in FIG. 7 in which parts having the same reference numerals as those of FIGS. 2 to 6 have the same functions.

With the shutter 32, a gear transmission means 161 for transmitting the driving force of the shutter motor 57 comprises a worm gear 162 fixedly mounted onto the driving shaft 57*a* of the shutter motor 57 and a worm wheel 163 meshed with the worm gear 162.

Figure 8:
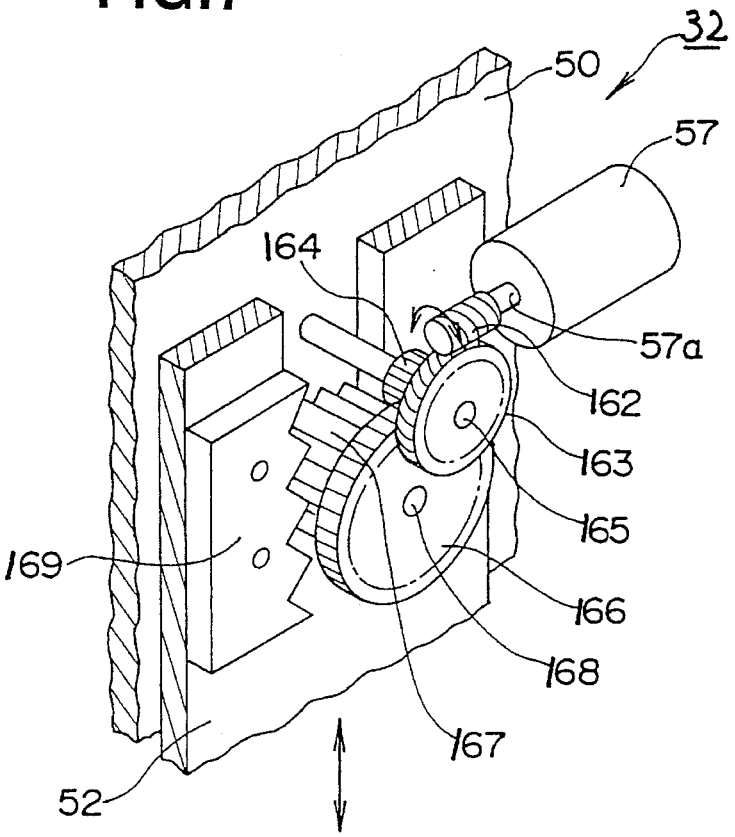
FIG. 8 is a perspective view of another example of the shutter.

Referring now to FIG. 8 showing an enlarged perspective view of a major part of the gear transmission means 161, a first spur gear 164 is fixedly mounted coaxially to the worm wheel 163 and the first spur gear 164 and worm wheel 163 are rotatably supported in the first plate 50 through a shaft 165.

The first spur gear 164 is meshed with a second spur gear 166 provided at the underside of the worm wheel 163, and a third spur gear 167 is fixedly mounted coaxially to the second spur gear 166. The third spur gear 167 and second spur gear 166 are rotatably supported in the first plate 50 through a shaft 168.

Meanwhile, the second plate 52 forming part of the shutter 54 is fixedly mounted with a rack 169 which in turn is engaged with the third spur gear 167.

With the gear transmission means 161 having such a structure as mentioned above, when the shutter motor 57 rotates in one direction as shown in FIG. 8, the driving force of the shutter motor 57 is transmitted to the second plate 52 via the worm gear 162, worm wheel 163, first spur gear 164, second Spur gear 166, third spur gear 167 and rack 169, which results in that the second plate 52 is pulled up by a predetermined distance to open the first bill transport passage 27 as shown in FIG. 5.

When the shutter motor 57 rotates in the other direction as shown in FIG. 8, on the other hand, the driving force of the shutter motor 57 is transmitted to the second plate 52 via the gear transmission means 161 similarly to the above route, so that the second plate 52 is pulled down by a predetermined distance to close the first bill transport passage 27 as shown in FIG. 6.

With the shutter 32 having the gear transmission means 161, when an external force is applied in a direction shown by an arrow D in order to forcibly push up the second plate 52 from its state of the closed bill transport passage as shown in FIG. 7, even the upward pushing of the second plate 52 from the closed transport passage state will not be transmitted due to the large gear resistance of the worm gear 162 and worm wheel 163, since the gear reduction mechanism of the worm gear 162 and worm wheel 163 having a large reduction ratio when viewed from the side of the shutter motor 57 and having a large frictional force between the meshed gears is provided between the shutter motor 57 and second plate 52 as shown in FIG. 8. Accordingly, this will not be followed by the corresponding rotation of the shutter motor 57 and thus the shutter 54 will not be moved upward.

In this manner, since the second plate 52 as part of the shutter 54 is not moved upward by the external force, it can be avoided that the external force after the shutter 54 closes the first bill transport passage 27 causes the bill transport passage to be opened, whereby the forcible taking,out of the inserted bill can be more effectively prevented.

Description will now be made as to the structure of a second bill transport means 60 disposed along the rising part 27*e* downstream of the first bill transport passage 27 as well as the structure of the bill judging means 33 for judging whether the inserted bill is genuine or false in FIG. 1.

The second bill transport means 60, as shown in FIG. 1, includes a transport belt 65 in the form of a cocked belt wound or run between a drive pulley 62 rotatably carried on a drive shaft 61 and a follower pulley 64 rotatably carried on a follower shaft 63. Also pressingly contacted with the transport belt 65 are follower rollers 66 and 67.

Further, a follower roller 68 is disposed at the start end of the rising part 27*e* as pressingly contacted with the follower roller 67.

A transport motor 69 for applying a driving force to the drive shaft 61 is provided in the topmost part of the main body 25 so that, when the transport motor 69 is driven, the drive shaft 61 is rotated through a gear transmission mechanism (not shown) disposed in the side of the main body 25.

In this manner, when the drive shaft 61 is driven, the inserted bill kept between the transport belt 65 and the follower rollers 66 and 67 and between the follower rollers 67 and 68 is forcibly transported toward the termination end 27*a* of the first bill transport passage 27.

The bill judging means 33 for judging whether the inserted bill is genuine or not is disposed between the drive shaft 61 and follower shaft 63 of the second bill transport means 60.

The bill judging means 33 comprises a photo sensor 70 and a magnetic sensor 71 for detecting the varying density and magnetic change of the bill passed through the first bill transport passage 27. The genuineness of bills is judged not on the basis of output signals of the photo and magnetic sensors 70 and 71.

The photo sensor 70 is made up of light emitting and receiving elements 70*a* and 70*b* which are opposingly disposed with the rising part 27*e* of the first bill transport passage 27 being therebetween (or disposed in parallel at the rising part 27*e*). The magnetic sensor 71 is made up of a magnetic head 71*a* and a pressure roller 71*b* which is brought into pressing contact with the magnetic head 71*a*.

By vertically disposing the bill judging means 33 along the rising part 27*e* of the first bill transport passage 27 as shown in FIG. 1, even if external dust is brought into the interior of the machine during passage of the bill (not shown) through the interior of the rising part 27*e*, the dust cannot be attached onto the detection surfaces of the light emitting and receiving elements 70*a* and 70*b* and magnetic head 71*a* because the dust falls downward from the detection surfaces.

When the first bill transport passage 27 is formed into an inverted U letter shape in a meandering form, the bill judging means 33 is disposed along a falling part (not shown) of the first bill transport passage 27. Even in this case, foreign matter such as dust cannot be attached onto the detection surfaces of the light emitting and receiving elements 70*a* and 70*b* and magnetic head 71*a*.

Description will then be made as to a second bill transport passage 29 and a bill stacking mechanism. The second bill transport passage 29 is formed as bent by an angle of about 90 degrees downward from the termination end 27*a* of the first bill transport passage 27, and transports the bills passed through the first bill transport passage 27 along the longitudinal direction of the stacker 28 (along the longitudinal direction of the main body 25). The bill stacking mechanism 90 stacks the bill transported through the second bill transport passage 29 into the stacker 28 one after another.

Along the second bill transport passage 29, a third bill transport means 80 is disposed. A part of the components of the third bill transport means 80 are shared with those of the second bill transport means 60.

More in detail, the third bill transport means 80, as shown in FIG. 1, comprises the drive pulley 62 rotatably carried on the drive shaft 61, the follower pulley 64 rotatably carried on the follower shaft 63, and the transport belt 65 in the form of a cocked belt wound or run between the drive pulley 62 and follower pulley 64.

Figure 9:
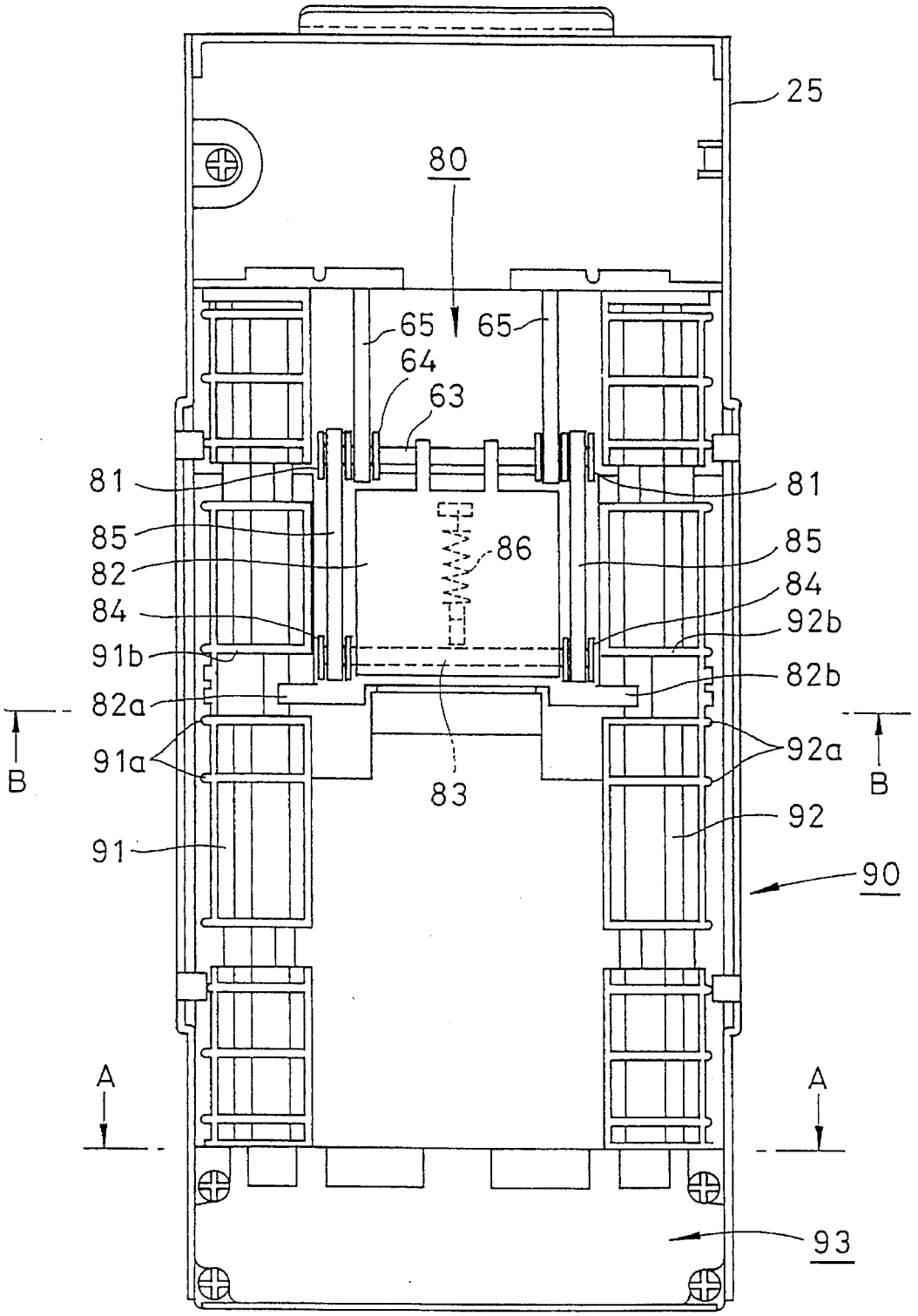
FIG. 9 is a rear view of a main body of the bill processor.

The third bill transport means 80, as shown by a rear view of the main body 25 with the stacker 28 removed therefrom in FIG. 9, comprises a follower pulley 81 rotatably carried on the follower shaft 63 outside the follower pulley 64, a chute plate 82 one end of which is rotatably carried on the intermediate part of the follower shaft 63, a follower shaft 83 rotatably supported in the tip end of the chute plate 82, a follower pulley 84 rotatably carried on the follower shaft 83, and a transport belt 85 in the form of a cocked belt wound or run between the follower pulleys 84 and 81. The chute plate 82, which forms a part of the bill stacking mechanism 90, is always energized toward its side of the back plate 25*a* of the main body 25 by a coil spring 86 provided between the rear side of the chute plate 82 and the back plate 25*a* as shown in FIG. 1 and stopped at such an initial position as shown in FIG. 1.

In this manner, with the third bill transport means 80, when the drive shaft 61 is rotated by the transport motor 69 disposed in the topmost part of the main body 25, the transport belts 65 and 85 following up the rotation of the drive shaft 61 rotate in the same direction, so that the third bill transport means 80 causes the inserted bill transported to the termination end 27*a* of the first bill transport passage 27 to be forcibly transported along the second bill transport passage 29.

The pulleys and transport belts of each bill transport means shown in FIG. 1 are provided respectively in pair as opposed to each other at the both sides of the shafts carrying the pulleys.

In FIG. 1, reference numeral 200 denotes an outlet lever which is disposed upstream the second bill transport passage 29 to detect the leading and trailing ends of the inserted bill transported through the second bill transport passage 29.

Description will next be made as to the bill stacking mechanism 90 for stacking the bill transported through the second bill transport passage 29 into the stacker 28 one after another.

Referring to FIG. 9, the bill stacking mechanism 90 comprises pairs of bill guide drums 91 and 92 located at both sides of interior of the main body 25 along its longitudinal direction to be supported rotatably in one direction around an axis between their upper and lower ends, and a drive device 93 for rotating the bill guide drums 91 and 92 in mutually opposite directions with the same phase.

The bill guide drums 91 and 92 are formed on their peripheries with latticed ribs 91*a* and 92*a* and also formed in their longitudinal direction (that is, in the direction of the second bill transport passage 29) with slits (to be described later) for guiding the inserted bill transported through the second bill transport passage 29.

The bill guide drums 91 and 92 are provided at their centers with notches 91*b* and 92*b* along their circumferential directions, into which notches projections 82*a* and 82*b* formed at both side of the tip end of the chute plate 82 are engaged.

Figure 10:
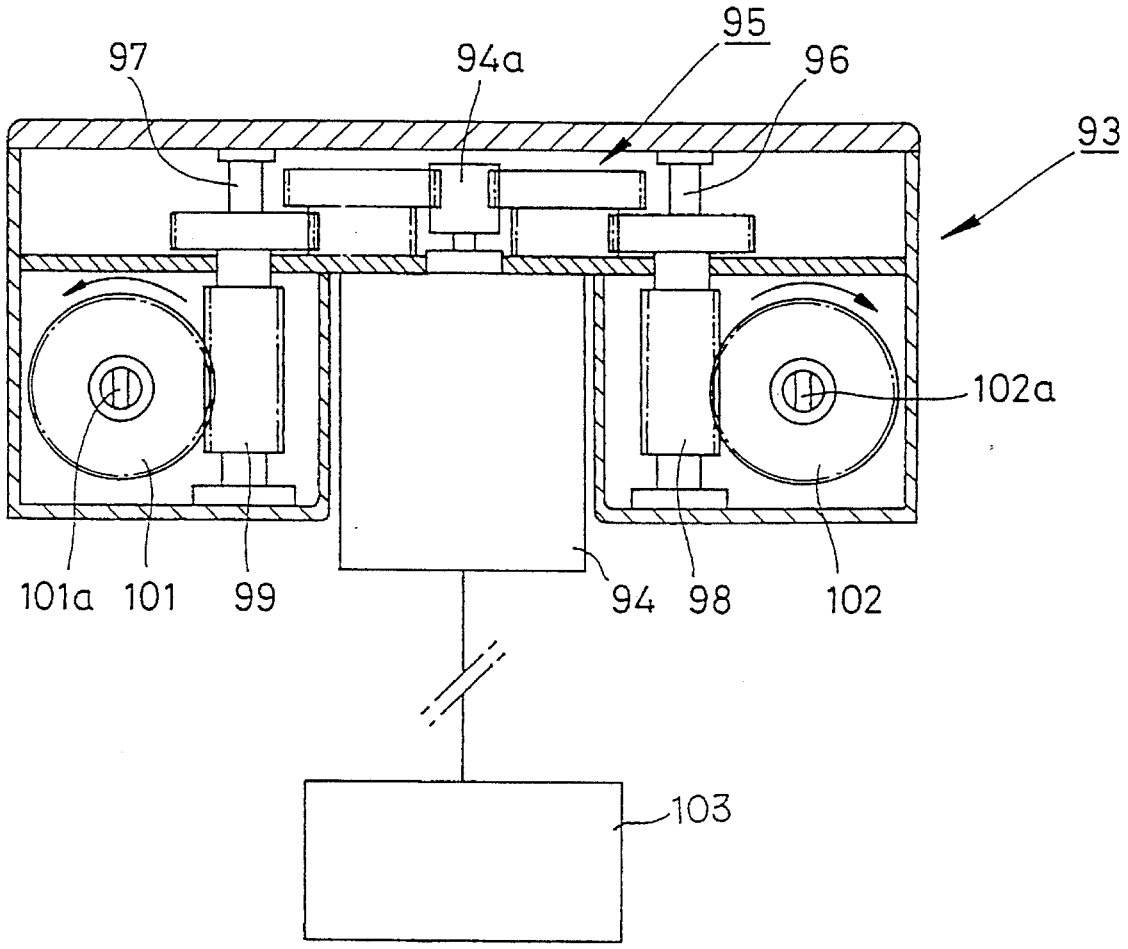
FIG. 10 is a view of a drive part of a bill stacking mechanism in the bill processor.

Referring to FIG. 10 which is an enlarged sectional view taken along line A—A of FIG. 9, the drive device 93 for driving the bill guide drums 91 and 92 comprises a stack motor 94 and a gear transmission device 95 meshed with a pinion 94*a* of the stack motor 94. Shafts 96 and 97 of the gear transmission device 95 provided at both sides thereof are mounted with worm gears 98 and 99 respectively which in turn are meshed with a pair of worm wheels 101 and 102 provided with projections 101*a* and 102*a* fitted into lower ends of the bill guide drums 91 and 92.

With the drive device 93, when the stack motor 94 is rotated in one direction, this causes the worm wheels 101 and 102 to rotate in such opposite directions as shown by arrows in the drawing with the same phase through the gear transmission device 95 and worm gears 98 and 99, and at the same time, this causes the bill guide drums 91 and 92 fittedly receiving the projections 101*a* and 102*a* of the worm wheels 101 and 102 to also rotate in their opposite directions with the same phase.

In FIG. 10, reference numeral 103 denotes a stacker-full detection device (to be described later) connected to the stack motor 94.

The operation and structure of the bill stacking mechanism 90 will next be described.

Figure 11:
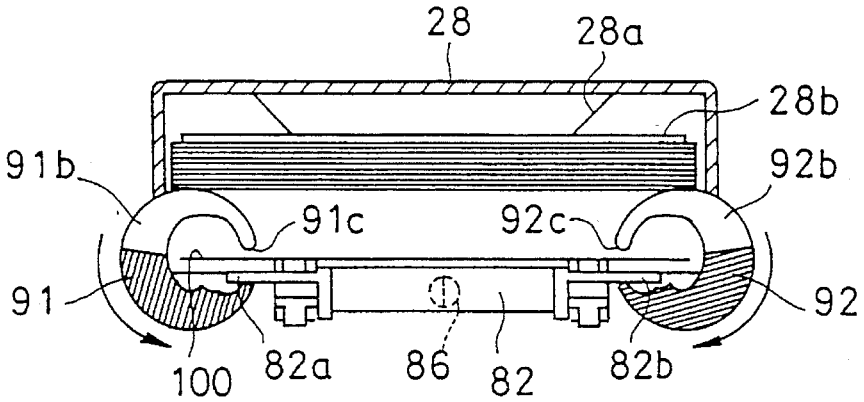
FIGS. 11 through 15 are cross-sectional views of the drive part for explaining the operation of the bill stacking mechanism.

Shown in FIG. 11 is a cross-sectional view taken along line B—B in FIG. 9, especially illustrating a state when the stacker 28 is mounted onto the rear side of the processor main body.

Referring to FIG. 11, bill guide grooves 91*c* and 92*c* are formed in the peripheral surfaces of the bill guide drums 91 and 92 in the axial direction of the drums, i.e., in the transport direction of the second bill transport passage 29. In the initial positions of the bill guide drums 91 and 92, the bill guide drums 91 and 92 are stopped so that the bill guide grooves 91*c* and 92*c* are opposed to each other to receive the bill from its leading end side.

When a bill 100 is guided into the bill guide grooves 91*c* and 92*c* of the bill guide drums 91 and 92 by the third bill transport means 80 and reaches a predetermined position as shown in FIG. 11, the bill guide drums 91 and 92 start their rotating operation in the mutually opposite directions as shown by arrows with the same phase.

Figure 12:
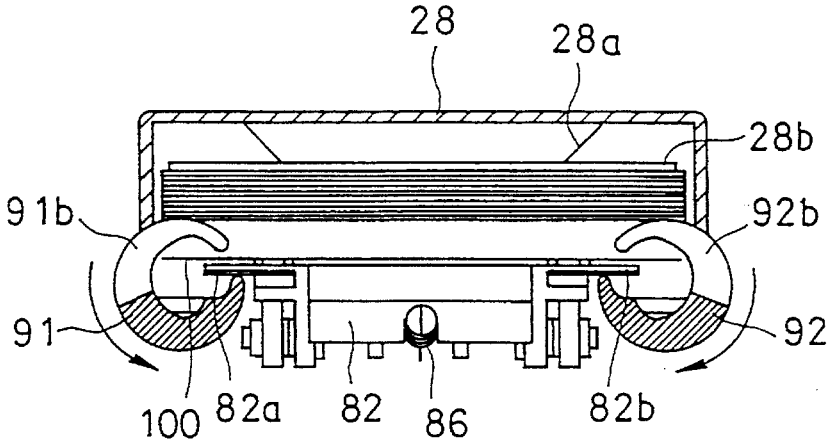
Figure 13:
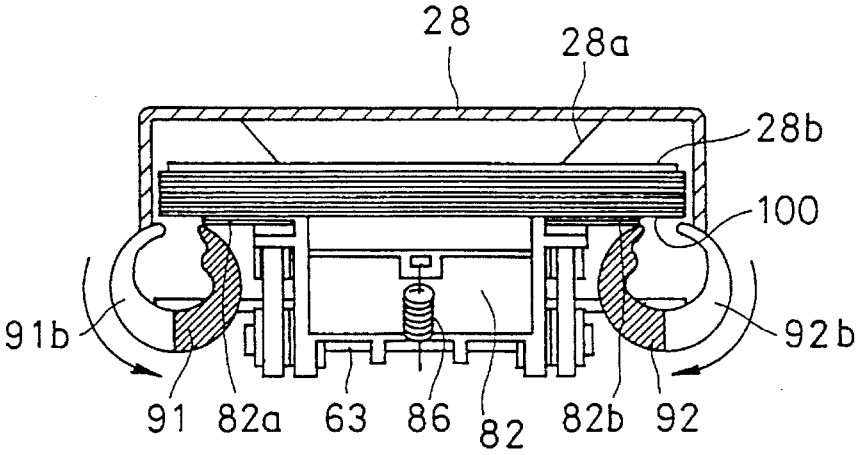

When the bill guide drums 91 and 92 rotate in the mutually opposite directions (the bill guide drum 91 in the counterclockwise direction and the bill guide drum 92 in the clockwise direction in FIG. 11) as shown by arrows with the same phase in this manner, the bill 100 is moved toward the stacker 28 in parallelism thereto by the bill guide grooves 91*c* and 92*c* and held as pushed between a stacker plate 28*b* and the outer peripheral surfaces of the bill guide drums 91 and 92 against the pushing force of a stack spring 28*a* provided in the stacker 28, as shown in FIGS. 12 and 13. At the same time, the chute plate 82 of the second bill transport passage 29 having the projections 82*a* and 82*b* engaged in the bill guide grooves 91*c* and 92*c* formed in the notches 91*b* and 92*b* portions of the bill guide drums 91 and 92 is moved toward the stacker 28 as the bill guide drums 91 and 92 rotate, so that the bill 100 is pushed nearly at its central part toward the stacker.

Accordingly, even if a frictional force occurs between the both sides of the bill and the outer peripheral surfaces of the bill guide drums 91 and 92, the bill 100 is forcibly pushed toward the frontmost row of the stacker 28, which results in that the bill 100 can be prevented from being caught in the bill guide drum 91 or 92 and thus can be reliably accommodated in the stacker 28.

With the bill processor 20, the chute plate 82 for pushing the bill nearly at its central part toward the stacker is provided operatively in association with the stacking operation of the bill through the bill guide drums 91 and 92. Thus, even if a frictional force occurs between the both sides of the bill and the outer peripheral surfaces of the bill guide drums 91 and 92 being rotated, the bill is pushed toward the frontmost row of the stacker by the bill pushing plate 82, whereby the bill will not be caught into the bill guide drums and can be stacked in the stacker. Accordingly, the processor can be made thin while avoiding the deterioration of the bill accommodating function.

Figure 14:
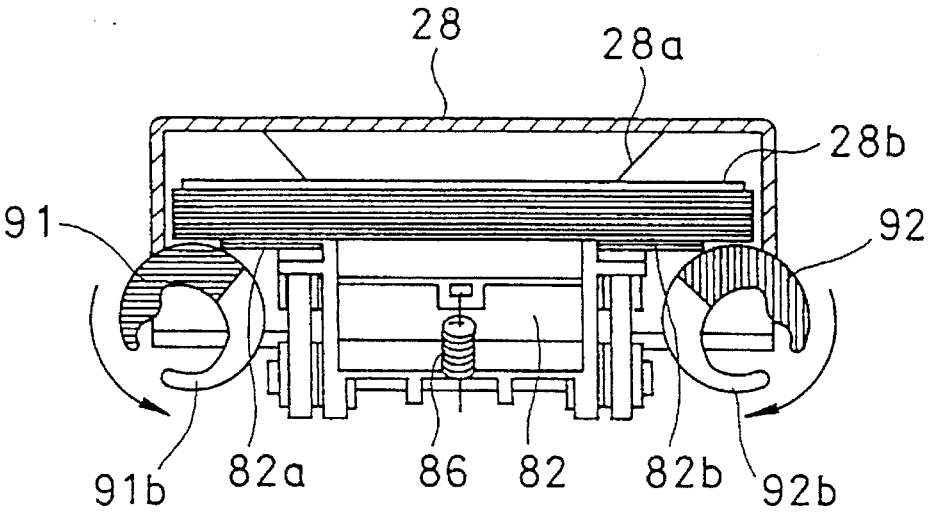

Even after the bill 100 guided in the bill guide grooves 91*c* and 92*c* is accommodated in the stacker 28, the bill guide drums 91 and 92 continue to rotate in the same directions as the above as shown in FIG. 14. At this time, as shown in FIG. 15, when the drums rotate beyond a predetermined rotational angle, the notches 91*b* and 92*b* of the bill guide drums 91 and 92 causes the engagement between the bill guide grooves 91*c* and 92*c* and projections 82*a* and 82*b* to be released, and further, the returning force of the coil spring 86 causes the chute plate 82 to be instantly returned to the initial position for guide of the next inserted bill.

Figure 15:
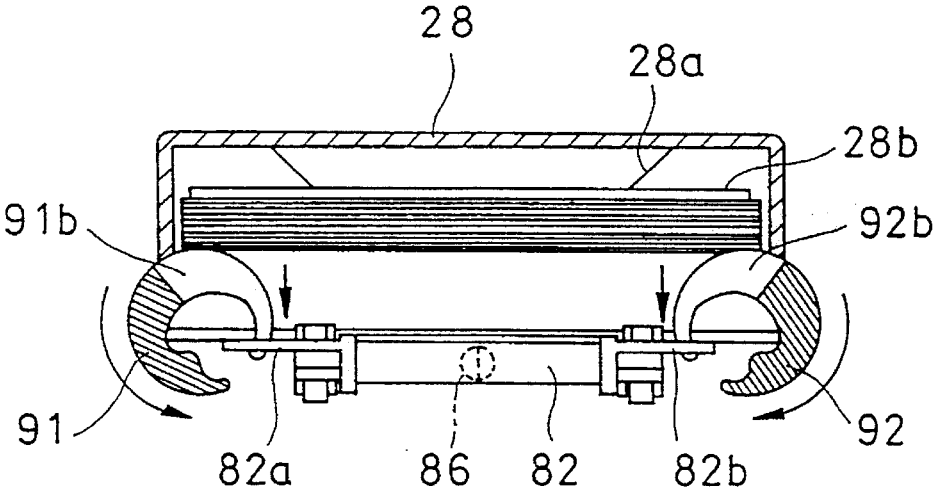

When the bill guide drums 91 and 92 rotate further from such a position as shown in FIG. 15 and reach such a position as shown in FIG. 11, the drums stop their rotating operation to return the next inserted bill to the initial position where the bill is to be stacked in the stacker 28.

Description will next be made as to the stacker-full detection device 103 connected to the stack motor 94.

Figure 16:
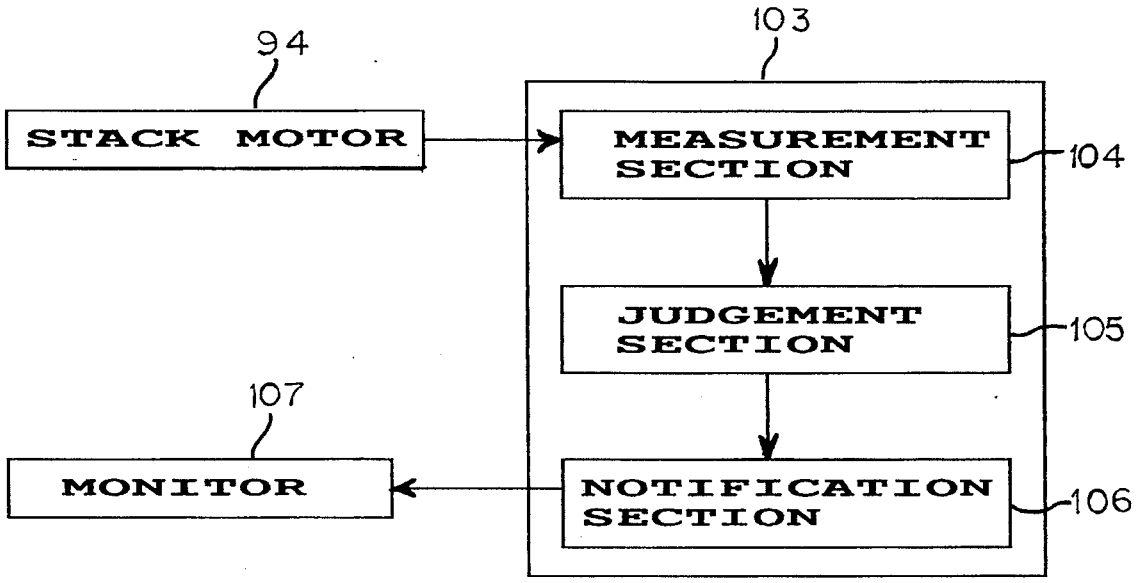
FIG. 16 is a block diagram of a stacker-full detection device.

Referring to FIG. 16, the stacker-full detection device 103 comprises a measurement section 104 for measuring a load output (such as a load current, a load voltage or the like) generated during driving operation of the stack motor 94, a judgement section 105 for judging whether or not the value of the load output measured by the measurement section 104 exceeds a preset value, and a notification section 106 for outputting a stacker-full detection signal to an external monitor device 107 according to a result of judgement by the judgement section 105. The functional blocks of FIG. 16 may comprise a circuit which includes as main components, e.g., a central processing unit (CPU), a ROM and a RAM).

A set value by the judgement section 105 is set on the basis of the measured value of the load output of the stack motor 94 when the stacker 28 reaches its full bill state. However, the set value may be suitably changed according to the capacity of the stacker, etc.

The stacker-full detection device 103 is installed in the bill processor 20 at a predetermined location (for example, in the drive device 93), but may be installed at any location so long as the stacker-full detection device 103 can be electrically connected to the bill processor 20. For example, the stacker-full detection device 103 can be mounted in a controller (not shown) located in the main body of a vending machine, etc. having the bill processor 20 mounted therein.

The operation and structure of the entire bill processor 20 having such a structure as mentioned above will next be detailed.

Figure 17:
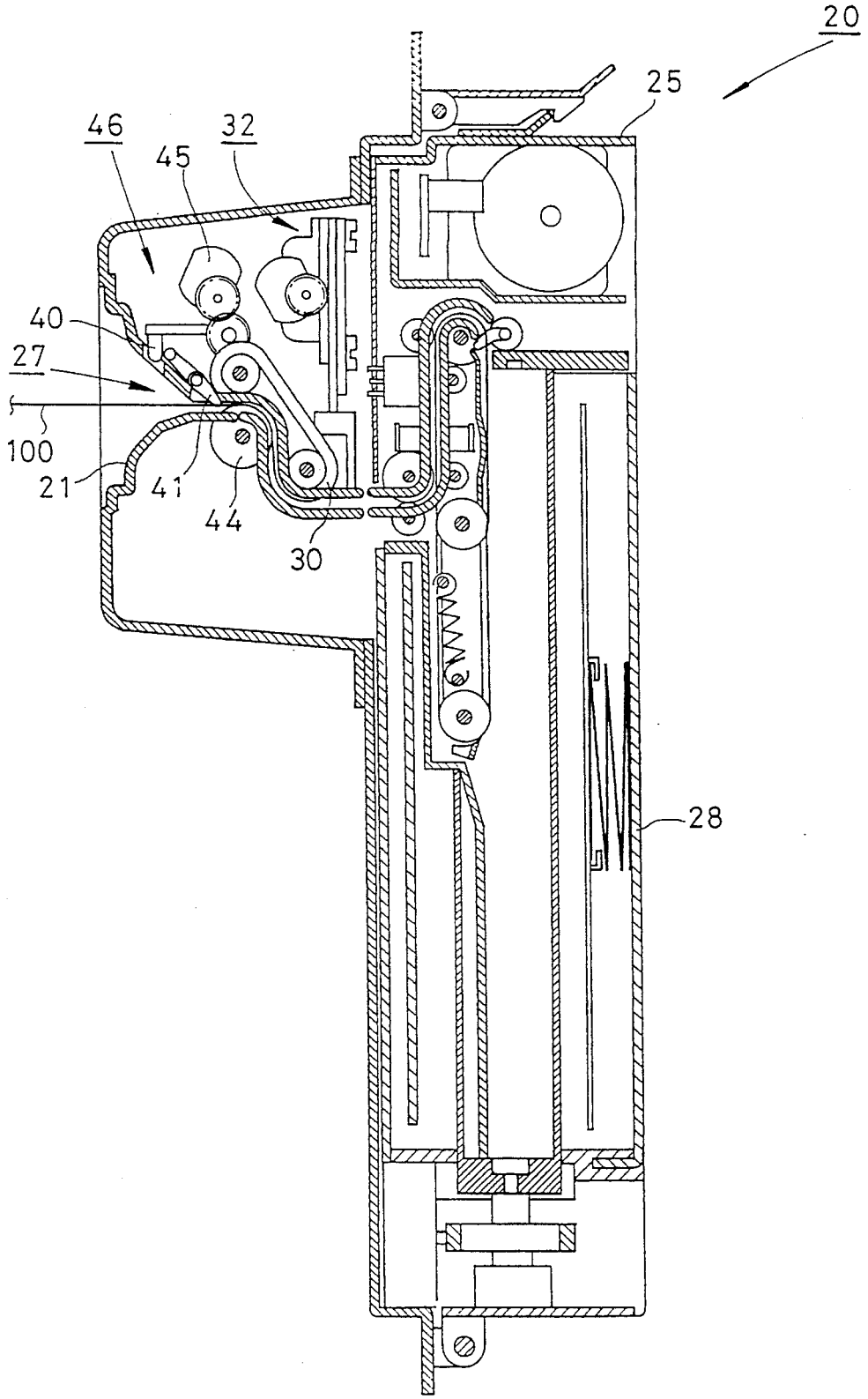
FIGS. 17 through 24 are cross-sectional views of the bill processor in accordance with the present invention for explaining the operation of the processor.

In FIG. 17, parts having the same reference numerals as those of FIG. 1 have the same functions. The inlet lever 41 is monitoring the bill insert slot 21. A sensor of the inlet lever detects the rotational or pivotal state of the lever. When the sensor detects that the lever state is abnormal, the shutter 32 is caused to close the first bill transport passage 27 to restrict or block further insertion of the inserted bill; whereas, when the sensor detects that the lever state is normal, the shutter 32 is caused to open the first bill transport passage 27 to allow further insertion or advancement of the inserted bill.

When the bill 100 is inserted through the bill insert slot 21 of the bill processor 20 and then the inlet lever 41 is rotated in the counterclockwise direction, the rotation of the lever causes the inlet sensor to be turned ON to detect advancement of the bill 100.

This causes the motor 45 of the first bill transport means 31 to be driven on the basis of a bill detection signal generated by the rotation of the inlet lever 41, so that the transport belt 30 is rotated in the counterclockwise direction, whereby the inserted bill 100 is gripped between the transport belt 30 and follower roller 44 and transported along the first bill transport passage 27 in the main body 25. At the same time as the first bill transport means 31, the second and third bill transport means 60 and 80 are also similarly driven on the basis of the bill detection signal generated by the rotation of the inlet lever 41 to cause the inserted bill 100 to be transported in the main body 25.

Figure 18:
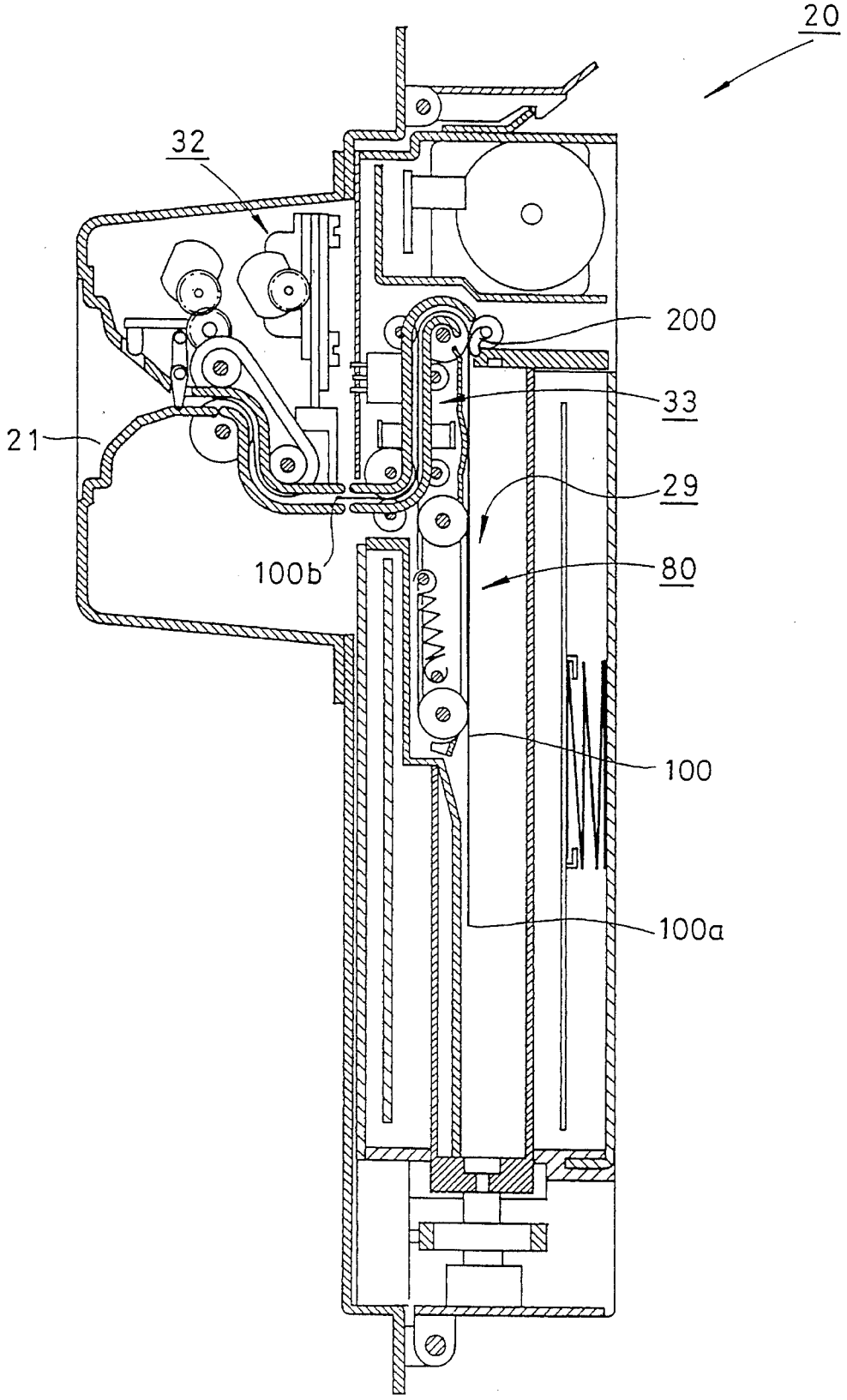

The genuineness of the bill 100 is judged on the basis of a detection signal of the bill judging means 33, during a period from the time when the leading end 100*a* of the bill 100 is transported while rotating the outlet lever 200 in the clockwise direction to the time when the trailing end 100*b* of the bill 100 arrives at the lower end of the shutter 32 as shown in FIG. 18.

At a position of the bill 100 as shown in FIG. 18, when the bill 100 is judged to be genuine by the bill judging means 33, the bill 100 regarded as genuine is transported further to the downstream side of the second bill transport passage 29 by the third bill transport means 80.

At a position of the bill 100 as shown in FIG. 18, when the bill 100 is judged to be false by the bill judging means 33, the first to third bill transport means 31, 60 and 80 are respectively reversely rotated to return the bill 100 to the bill insert slot 21.

Figure 19:
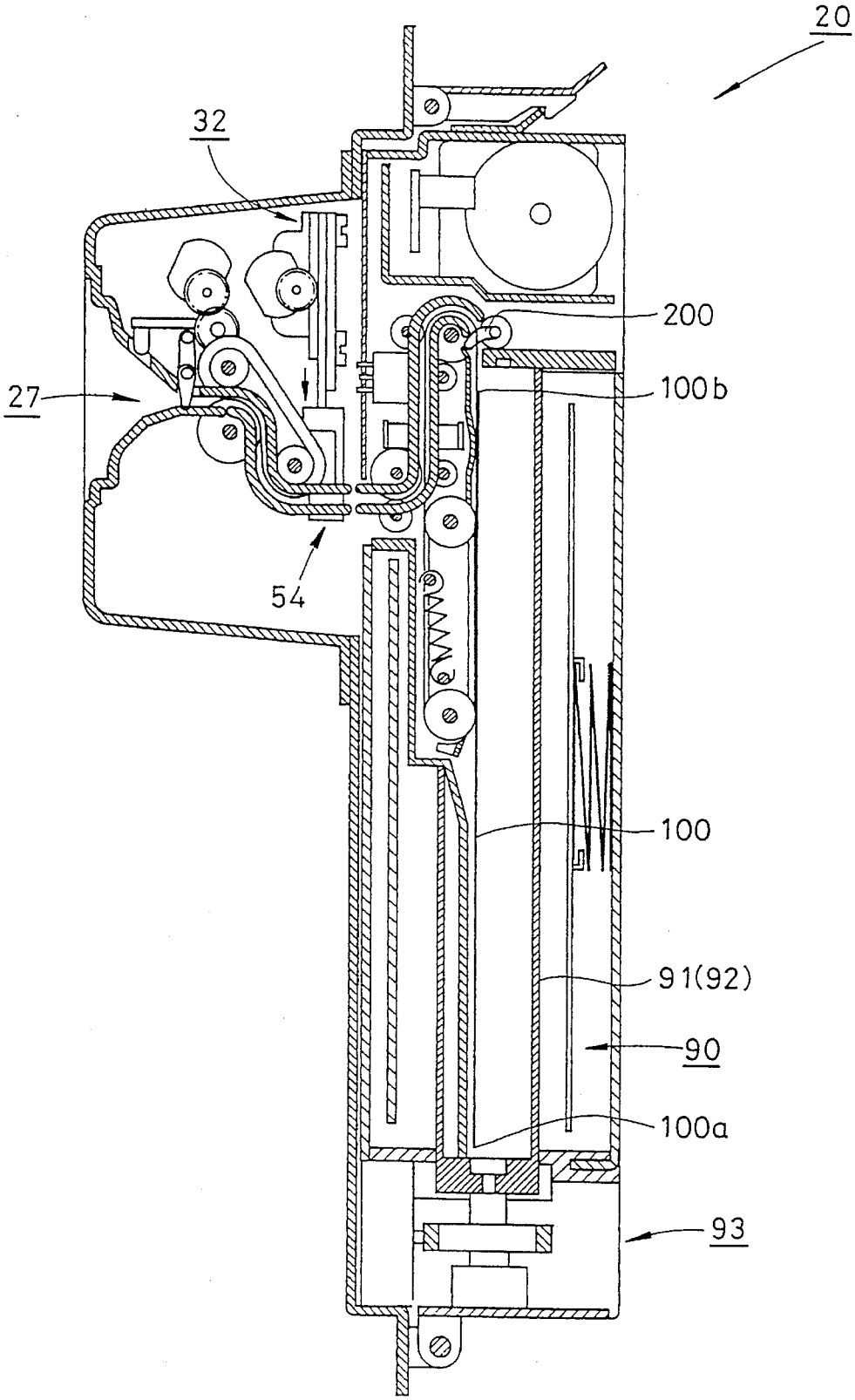

Referring to FIG. 19, when the bill 100 is judged to be genuine and the leading end 100*a* of the bill 100 is guided in the bill guide drums 91 and 92 of the bill stacking mechanism 90, the trailing end 100*b* of the bill 100 reaches at a position downstream of the outlet lever 200 functioning also as a pull-out prevention lever.

When the trailing end 100*b* of the bill 100 reaches the position downstream of the outlet lever 200 as shown in FIG. 19, the outlet lever 200 is counterclockwise rotated by the returning force of the return spring (not shown) again to its initial position where the second bill transport passage 29 is closed, which results in that the user cannot pull out the inserted bill 100 from the transport position of the bill 100 shown in FIG. 19.

When the outlet lever 200 for detecting the presence or absence of the bill is returned to the initial position as shown in FIG. 19, this causes the shutter 32 to be driven on the basis of the detection signal of the outlet lever 200, so that the first bill transport passage 27 is closed by the shutter 54 provided at the tip end of the shutter 32, whereby continuous bill insertion is prevented and driving of all the bill transport means is once stopped.

When it is detected on the basis of the detection signal based on the returned initial position of the outlet lever 200 that the trailing end 100*b* of the inserted bill 100 is passed through the position of the outlet lever 200 and then guided fully in the bill guide grooves 91*c* and 92*c* (see FIG. 11) formed in the bill guide drums 91 and 92 of the bill stacking mechanism 90, the detection signal causes the drive device 93 of the bill stacking mechanism 90 to be driven to start the stacking operation of the bill 100 in the stacker 28.

Figure 20:
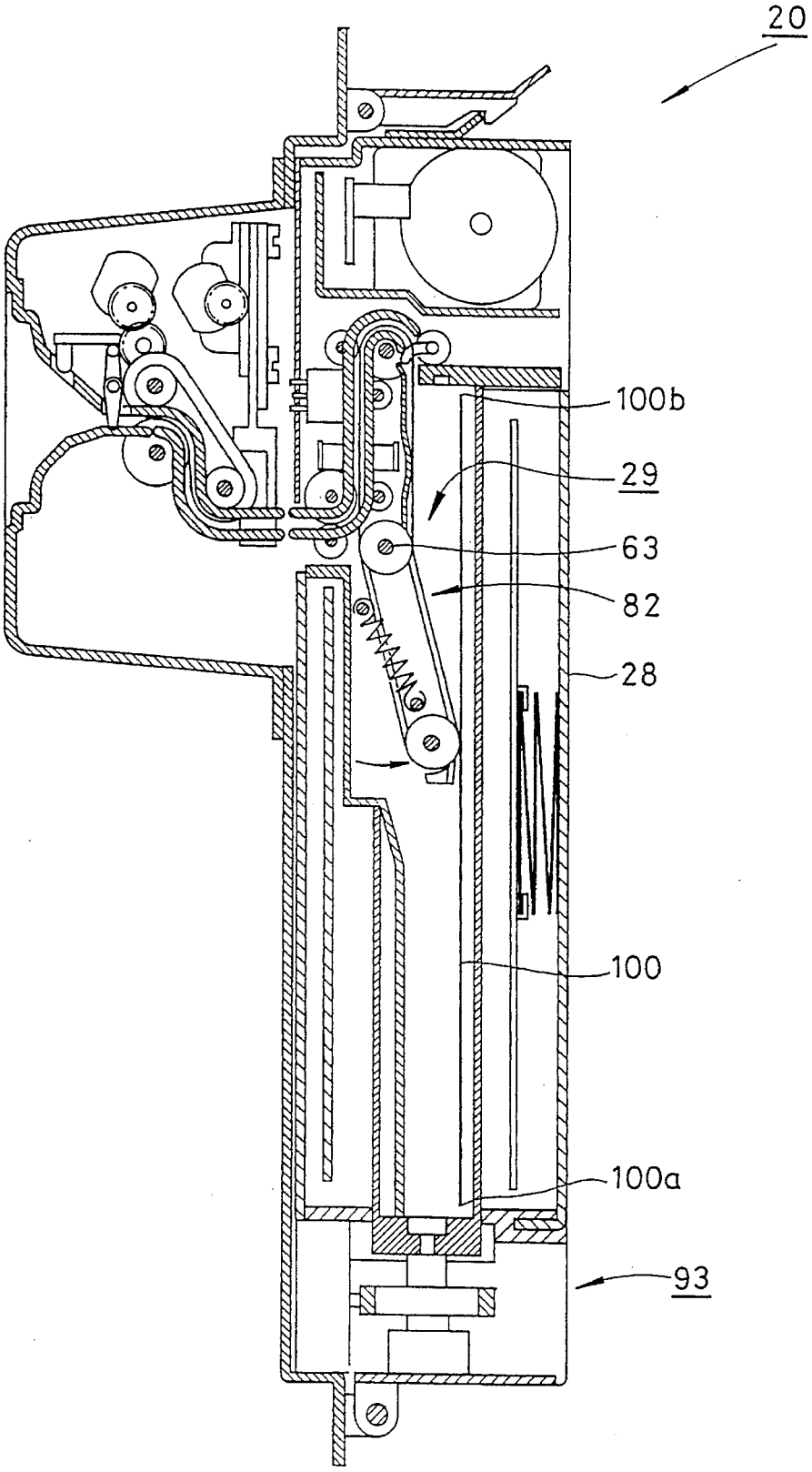

Referring to FIG. 20, when the drive device 93 of the bill stacking mechanism 90 is driven, the bill 100 guided in the bill guide grooves 91*c* and 92*c* (see FIG. 11) of the bill guide drums 91 and 92 is moved toward the interior of the stacker 28 in parallelism therewith as the bill guide drums 91 and 92 rotate in their one directions. At this time, in response to the rotation of the bill guide drums 91 and 92, the chute plate 82 forming a part of the second bill transport passage 29 is also counterclockwise rotated around the follower shaft 63 to cause the inserted bill 100 to be pushed toward the stacker 28.

Figure 21:
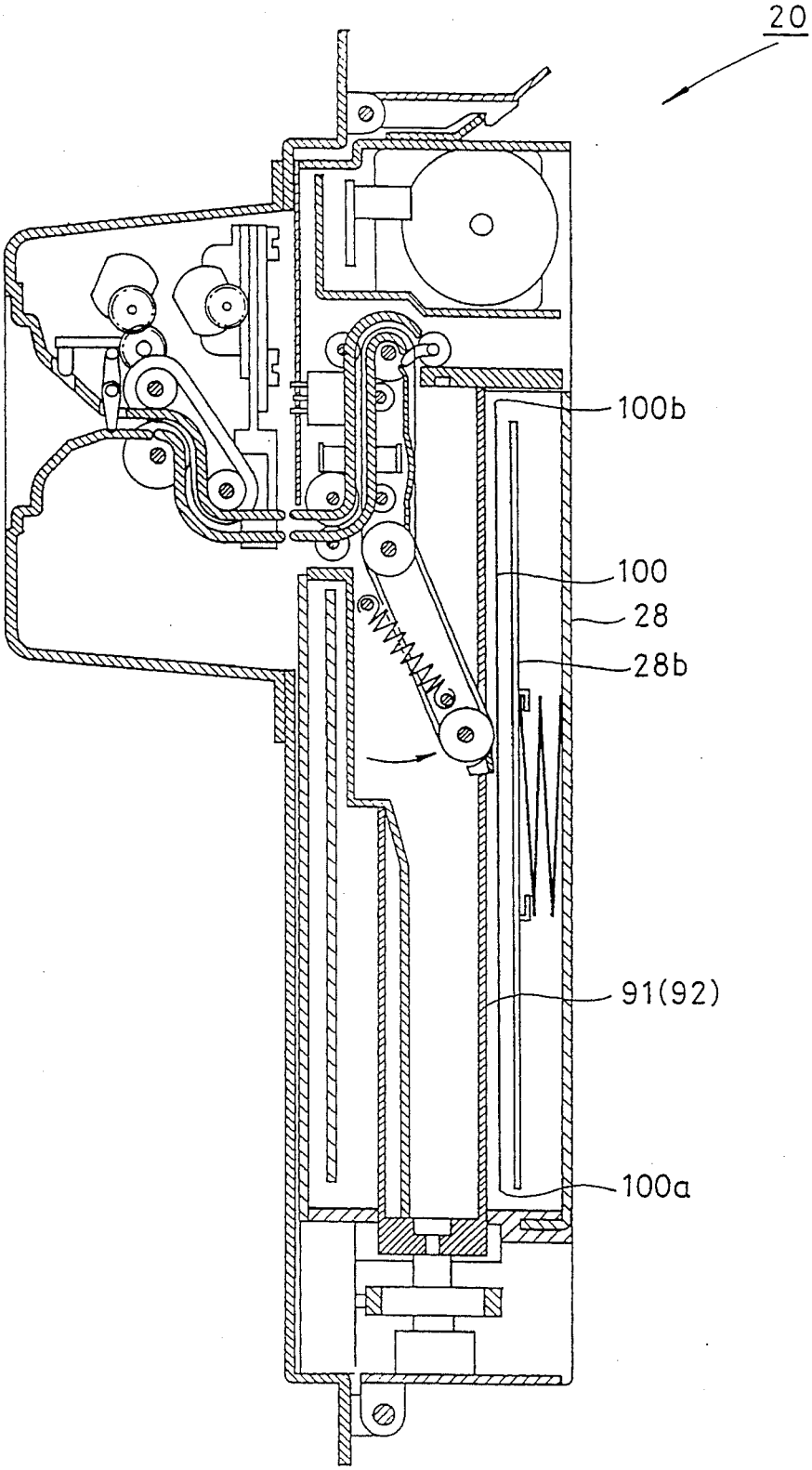
Figure 22:
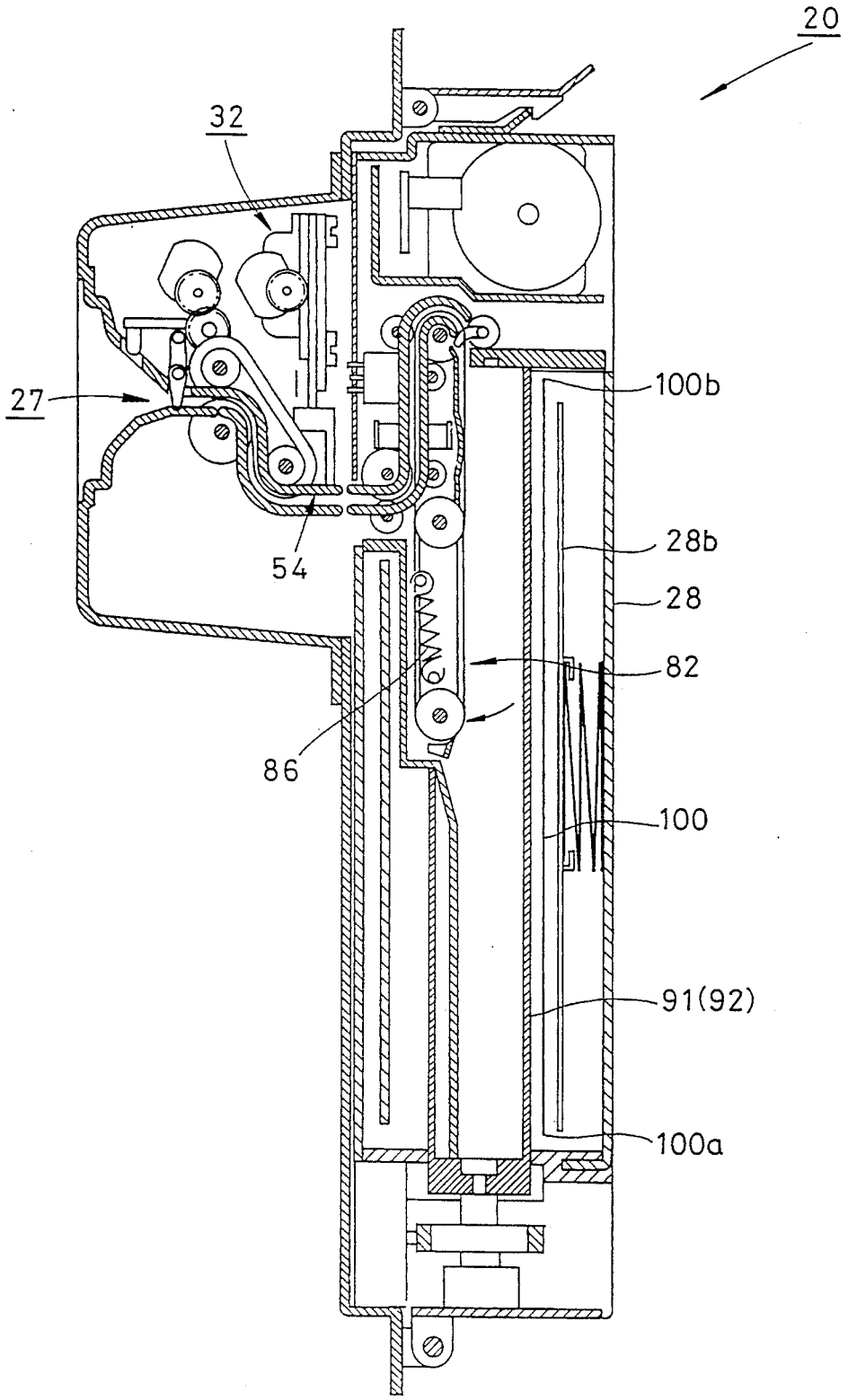

Referring to FIG. 21, when the bill 100 is pushed and held between the outer peripheral surfaces of the bill guide drums 91 and 92 and the stacker plate 28*b* and thereafter the bill guide drums 91 and 92 are further rotated to their initial positions, the chute plate 82 is returned to the initial position under the influence of the returning force of the coil spring 86 as shown in FIG. 22. On the basis of an output signal of a sensor (not shown) for detecting the returned initial positions of the chute plate 82, the shutter 54 of the shutter 32 is also returned to the initial position where the first bill transport passage 27 is to be opened, whereby the bill processor gets ready for acceptance of the next inserted bill as shown in FIG. 22.

Figure 23:
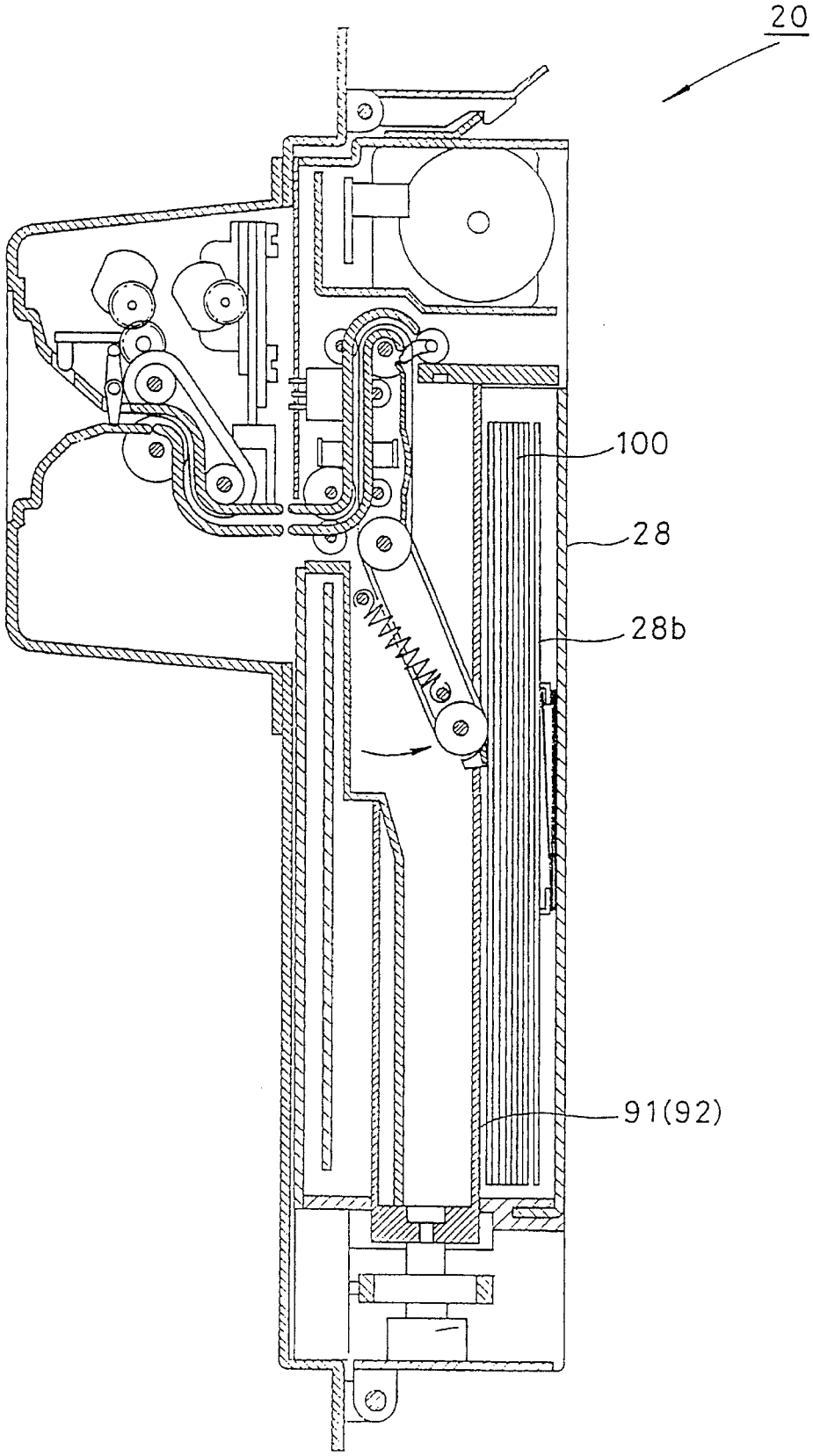

As the bill 100 is sequentially stacked in the stacker 28 through the aforementioned procedure, the thickness of the stacked bills 100 is increased, which results in that the resistance of the chute plate 82 becomes large when the bill is moved to the stacker as shown in FIG. 23. As described earlier, since the chute plate 82 is interlinked with the bill guide drums 91 and 92, the increase of the resistance of the chute plate 82 causes increase of the load output of the stack motor 94 (see FIG. 10) driving the bill guide drums 91 and 92. When the load output of the stack motor 94 exceeds its predetermined value due to the full stacking of bills, the stacker-full detection device 103 detects the full state that the bills are fully stacked in the stacker 28 and informs the external monitor device 107 (see FIG. 16) of the full state.

Figure 24:
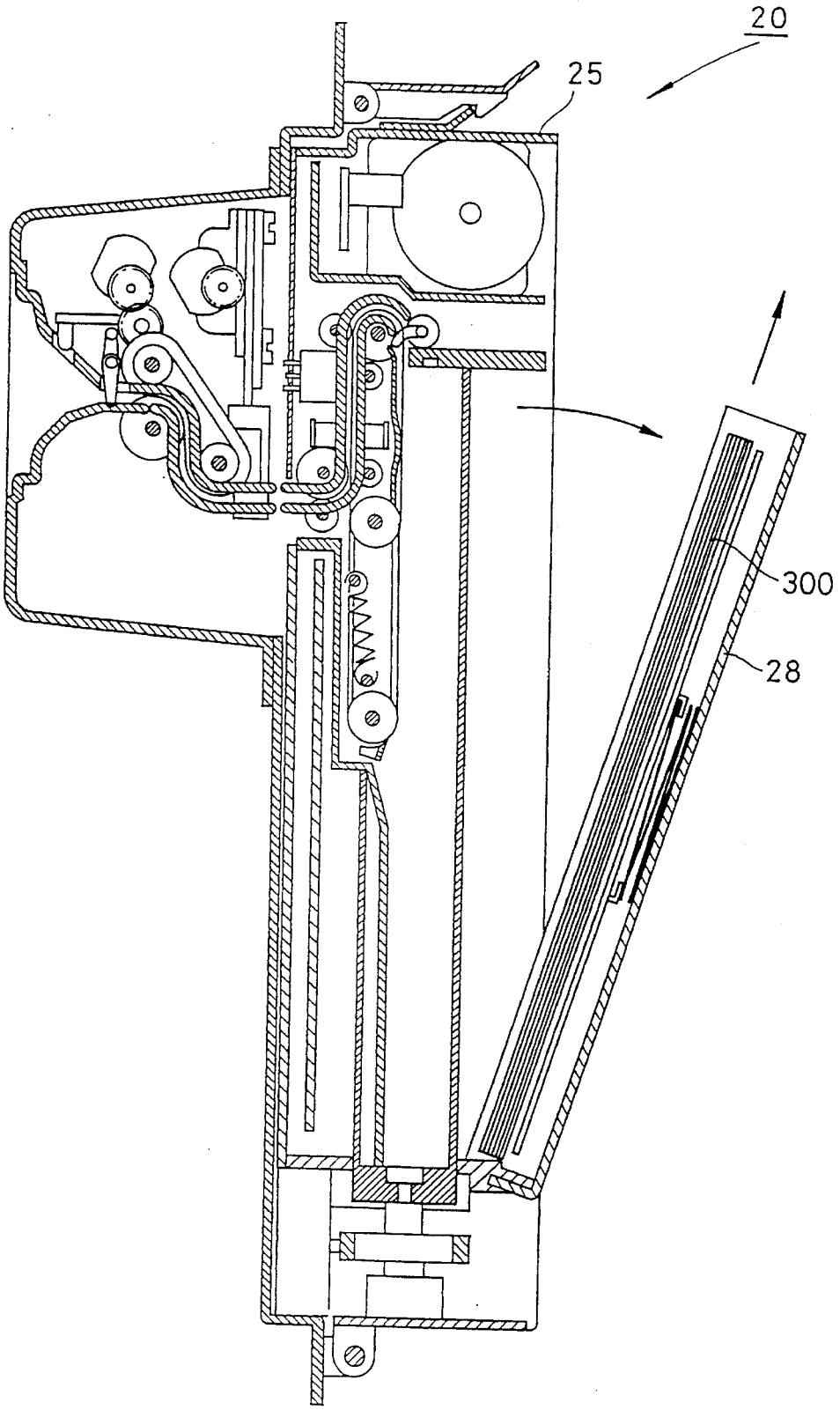

Referring to FIG. 24, after the stacker-full detection device 103 detects the full state of the stacker 28 and informs the external monitor device 107 of the full state, the owner or authorized money collecting person of the vending machine turns the stacker 28 around a supporting shaft (not shown) provided in the lower end of the stacker 28 in the clockwise direction toward the money collecting person from the inside of the main body 25 to open the upper part of the stacker 28 and then draws a bundle of the bills stacked (which is referred to as bill bundle 300) upward as shown by an arrow.

In the bill processor 20, since the stacker-full detection means is provided for detecting the full state of the stacker on the basis of the load output of the drive means when the bill pushing plate pushes the bill toward the stacker, the full state can be realized with such a simple arrangement of merely electrically connecting the stacker-full detection means to an existing bill processor. Further, since the full stack detection requires no such independent optical parts as photo sensors, a space for mounting the parts and the step for the part mounting become unnecessary. Thus, the full bill state can be realized without causing increase of the size of the stacker and increase of the cost.

Description will then be made as to a box lever for preventing the possible scattering of the bill bundle 300 stacked in the stacker 28 during the collection of the bill bundle 300.

Figure 25:
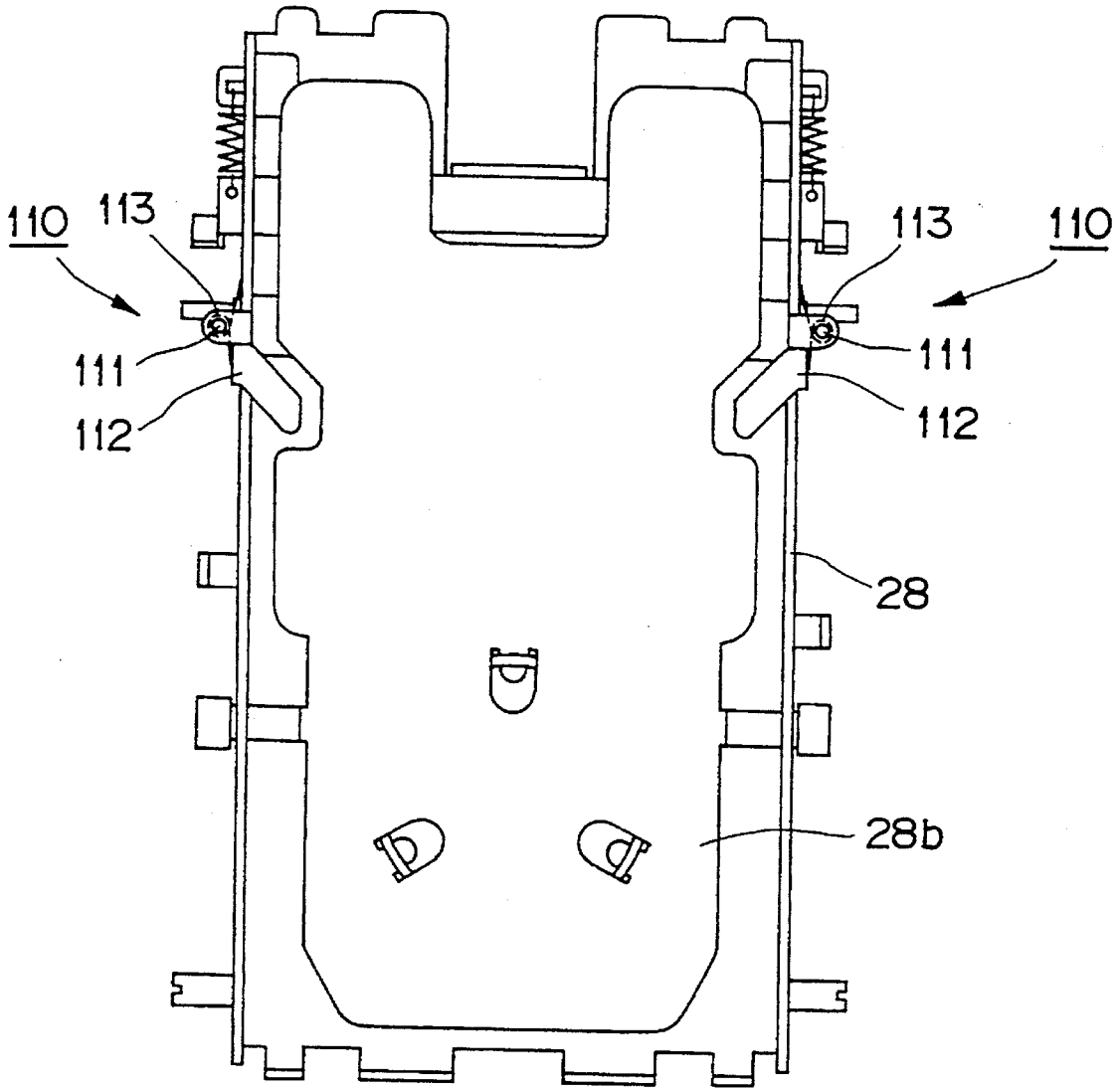
FIGS. 25 and 26 are plan views of a stacker with a box lever.

Referring to FIG. 25 showing a plan view of the stacker 28, box levers 110 for preventing the scattering of the bill bundle partly bound at its both sides are provided at the both sides of the stacker 28 in order to prevent the scattering of the bill bundle during the collection of the bill bundle stacked in the stacker 28 by drawing the bundle upward.

The box levers 110, which are provided in pair as opposed to each other at the both sides of the stacker 28, comprises a lever 112 of a generally L shape pivotably supported on shaft 111 and a coil spring 113 wound around the shaft 111. The lever 112 is energized clockwise around the shaft 111 by the coil spring 113 so that when the stacker 28 is not mounted in the main body 25, the lever 112 is engaged in such a state as shown in FIG. 25.

Figure 26:
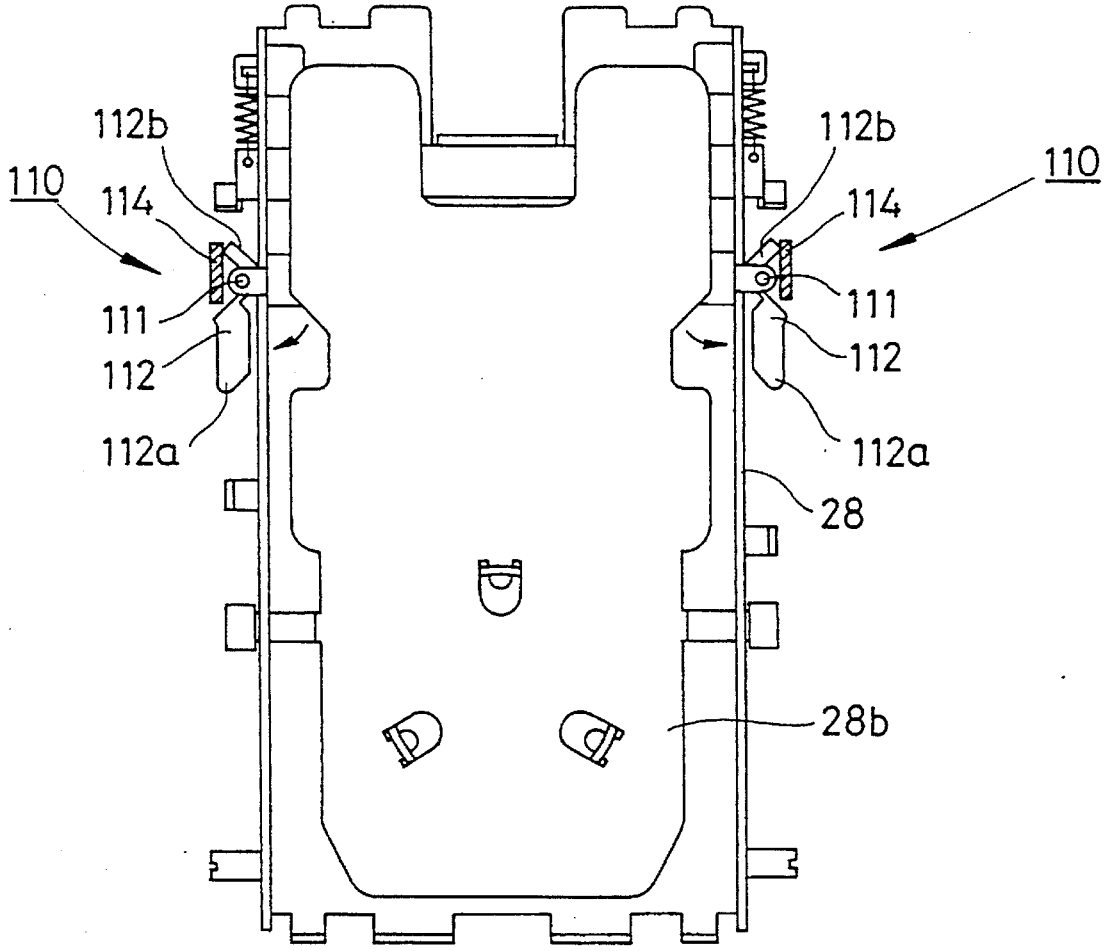

Referring to FIG. 26, when the stacker 28 is mounted into the main body 25, a rear end 112*b* of the box lever. 110 abuts against a box lever guide 114 of a circular disk shape provided in the main body 25. As a result, the box lever 110 rotates in such a direction as shown by arrows around the shaft 111 along the contour of the box lever guide 114 to move a lever tip end 112*a* of the box lever 110 out of the top surface of the stacker plate 28*b*. Accordingly, it can be avoided that the box lever 110 hinders the bill stacking operation.

Figure 27:
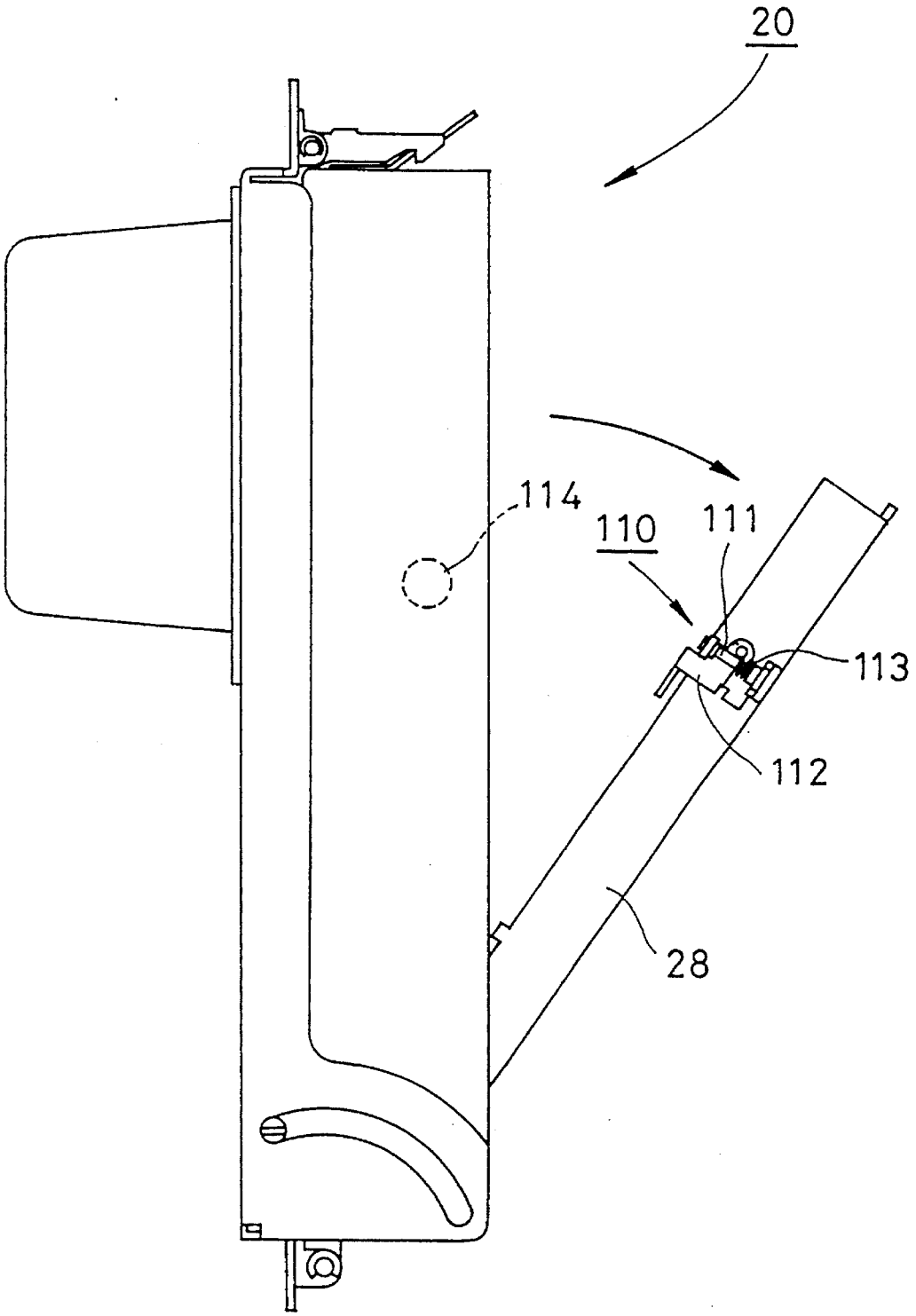
FIG. 27 is a side view of the bill processor illustrating the box levers.
Figure 28:
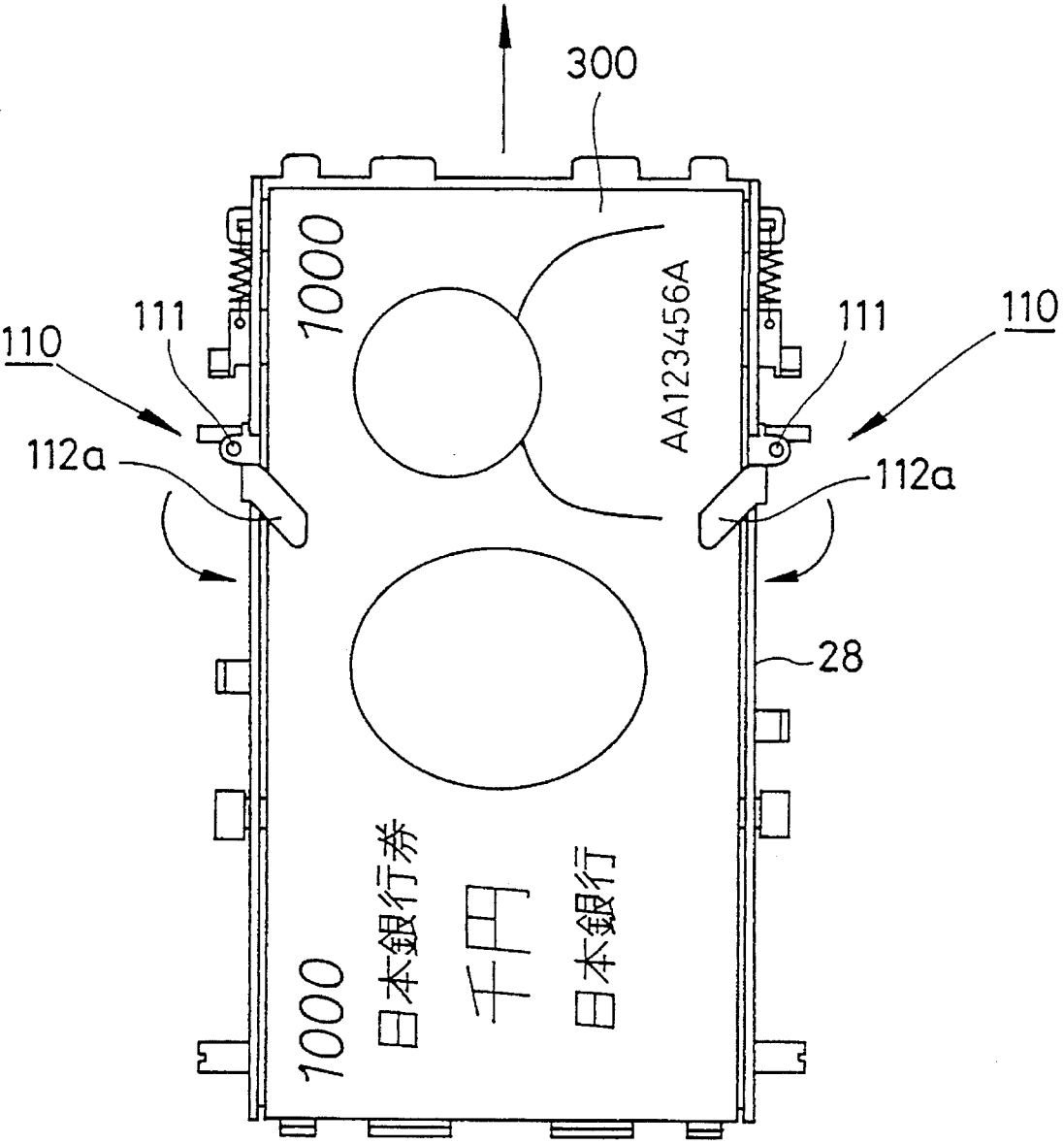
FIG. 28 is a plan view of the stacker for explaining the operation of the box lever.

Referring to FIG. 27, when the stacker 28 becomes full of stacked bills and the money collecting person dismounts the top part of the stacker 28 from the main body 25, the pushing force of the coil spring 113 wound around the shaft 111 causes advancement of the lever tip ends 112*a* of the levers onto the upper surface of the bill bundle 300 as shown in FIG. 28 to restrain the top surface of the bill bundle 300 at its both sides, whereby it can be prevented that the bill bundle 300 is possibly scattered during money collecting person's pulling out of the bill bundle 300 upward from the stacker 28 as shown by an arrow.

In this manner, during the collection of the bill bundle 300 stacked in the stacker 28, since the bill bundle 300 is partly restrained at its both sides by the lever tip ends 112*a* of the levers, the bill bundle 300 can be held in the form of a block or bundle in the stacker 28.

Accordingly, the money collecting person can easily pull out the stacked bill bundle 300 from the top of the stacker 28 in the form of a block without scattering the bill bundle 300.

Figure 29:
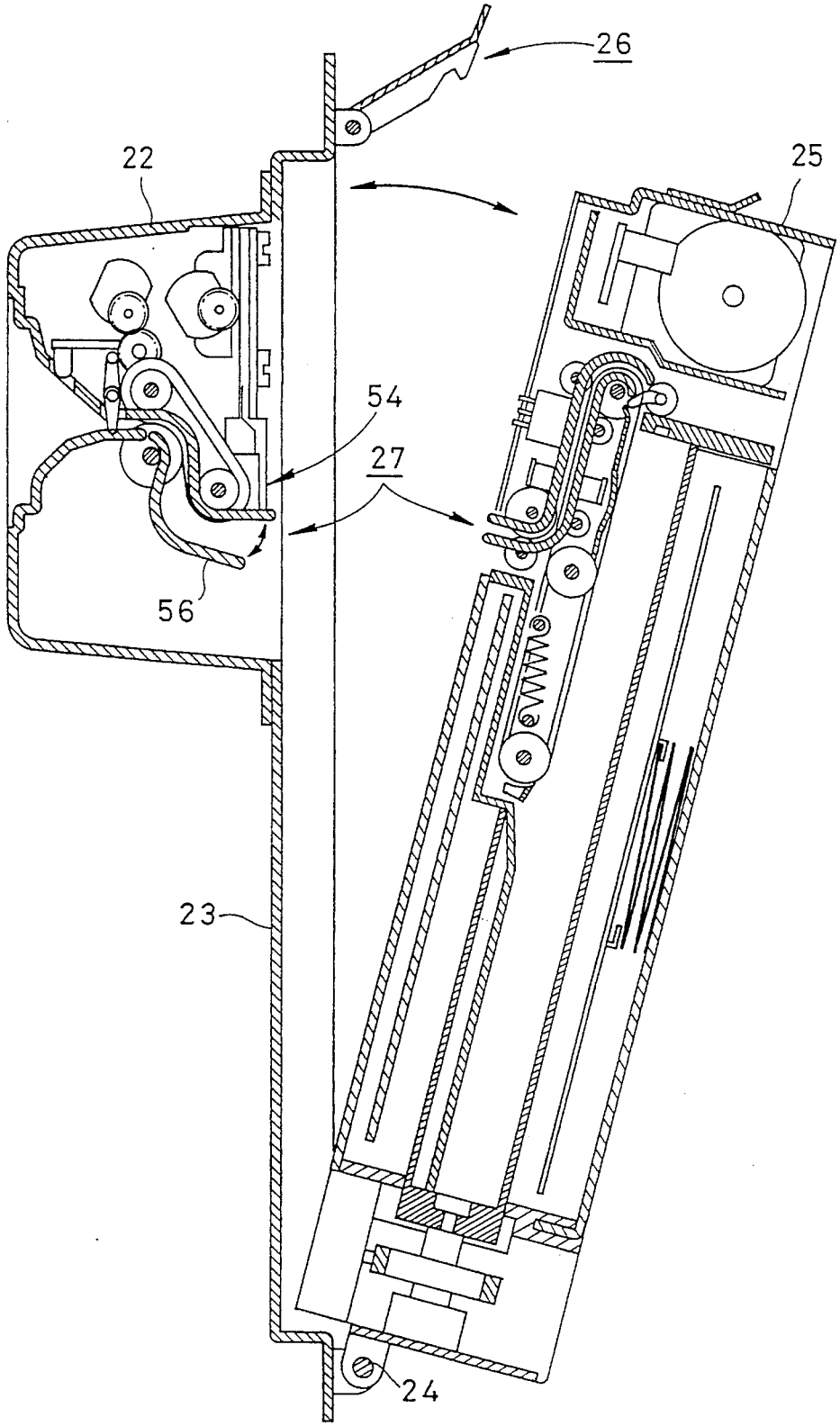
FIG. 29 is a cross-sectional view of the bill processor in accordance with the present invention for explaining the operation of the processor.

In the bill processor 20, the main body 25 can be opened and closed around the shaft 24 that is provided in its lower end with respect to the front plate 23 as shown in FIG. 29. Thus, when it is desired to inspect the first bill transport passage 27 against its bill clogging or jamming for maintenance, the inspection worker releases the engagement between the main body 25 and front plate 23 by the latch means 26 and turns the main body 25 clockwise around the shaft 24 to make an opening between the main body 25 and front plate 23. Since this causes the first bill transport passage 27 to be released, the workability can be improved. Further, when the inspector turns the lower chute 56 of the first bill transport passage 27 clockwise, the first bill transport passage 27 positioned on the lower surface of the shutter 54 can be opened and thus its maintenance and inspection can be further improved.

With the bill processor 20, the restraint means are provided at the both sides of the stacker for releasing the restraint of the bill bundle when the bill processor 20 is mounted to the machine main body and for partly restraining the bundle at its both sides when the bill processor 20 is released from the main body. To collect the stacked bills, the bills are in the form of a bundle (not bound) in the stacker and thus the money collecting person can easily pull out the bundle from the top side of the stacker without scattering the bundle.

Description will next be made as to a connection means 120 for preventing illegal taking-out of the bills stacked in the stacker 28. The connection means 120, as shown by a schematic perspective view in FIG. 30, is provided on the rear side of the bill processor 20.

Mounted on the right side surface of the stacker 28 is an arm 122 of a substantially L shape having an opening 121 formed therein. Mounted on the right side surface of the main body 25 is an arm receiver 124 having an opening 123 formed therein to communicate with the opening 121 of the arm 122 when the stacker 28 is mounted in the main body 25.

The connection means 120 is fixedly held to be able to be dismounted when its mounting is unnecessary. In other words, the arm 122 is formed therein with two holes 125 for screw fixing, so that the arm 122 is fixed to the side surface of the stacker 28 by means of screws 126 passed through the holes 125. Further, the arm receiver 124 is fixedly mounted onto the side surface of the main body 25 by means of a screw 127. In this connection, the stacker 28 and main body 25 are formed in their side surfaces with internal or female threads corresponding to the screws at their predetermined positions.

Figure 30:
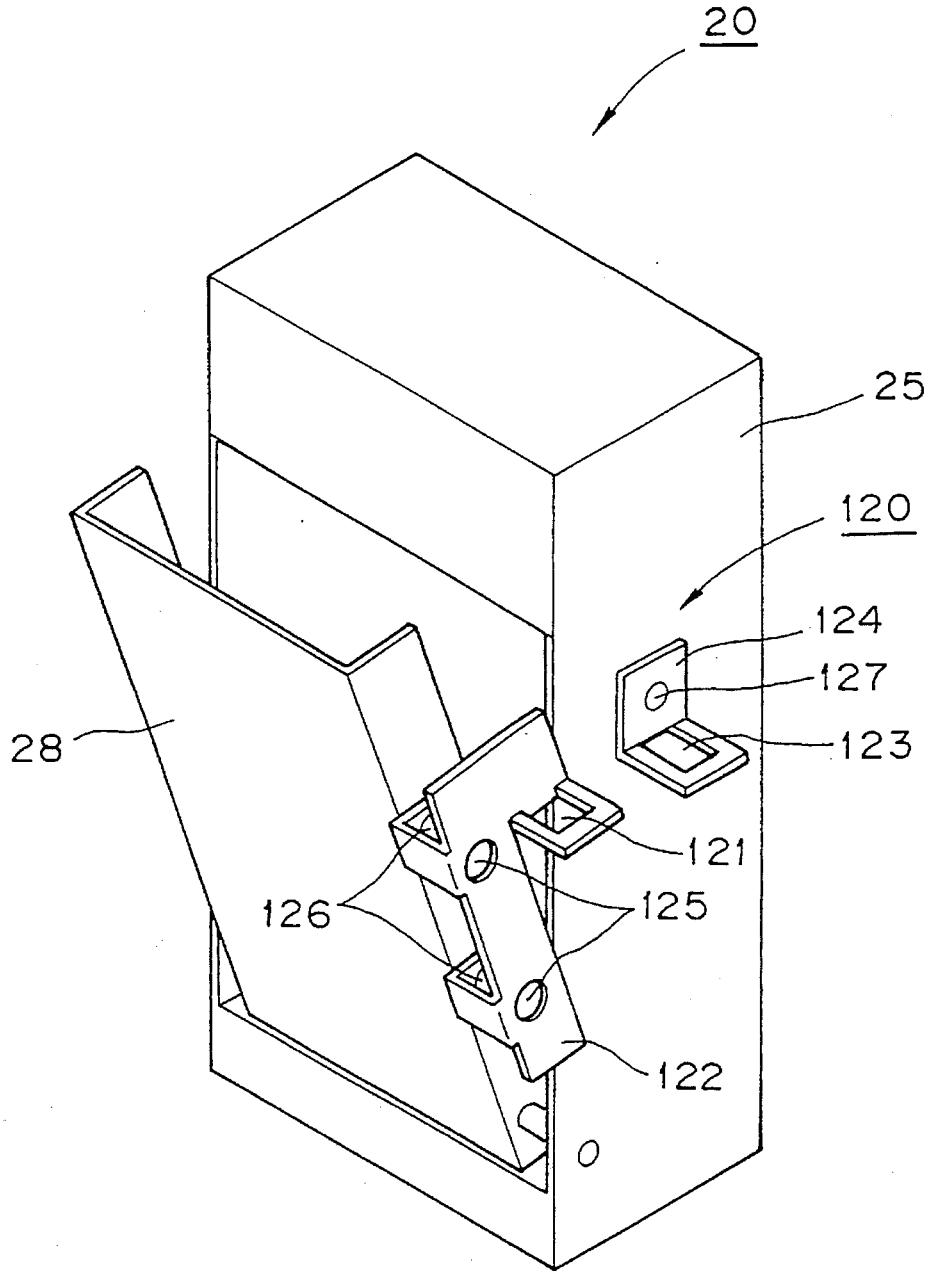
FIG. 30 is a perspective view of the bill processor in accordance with the present invention for explaining the operation of a connection means.
Figure 31:
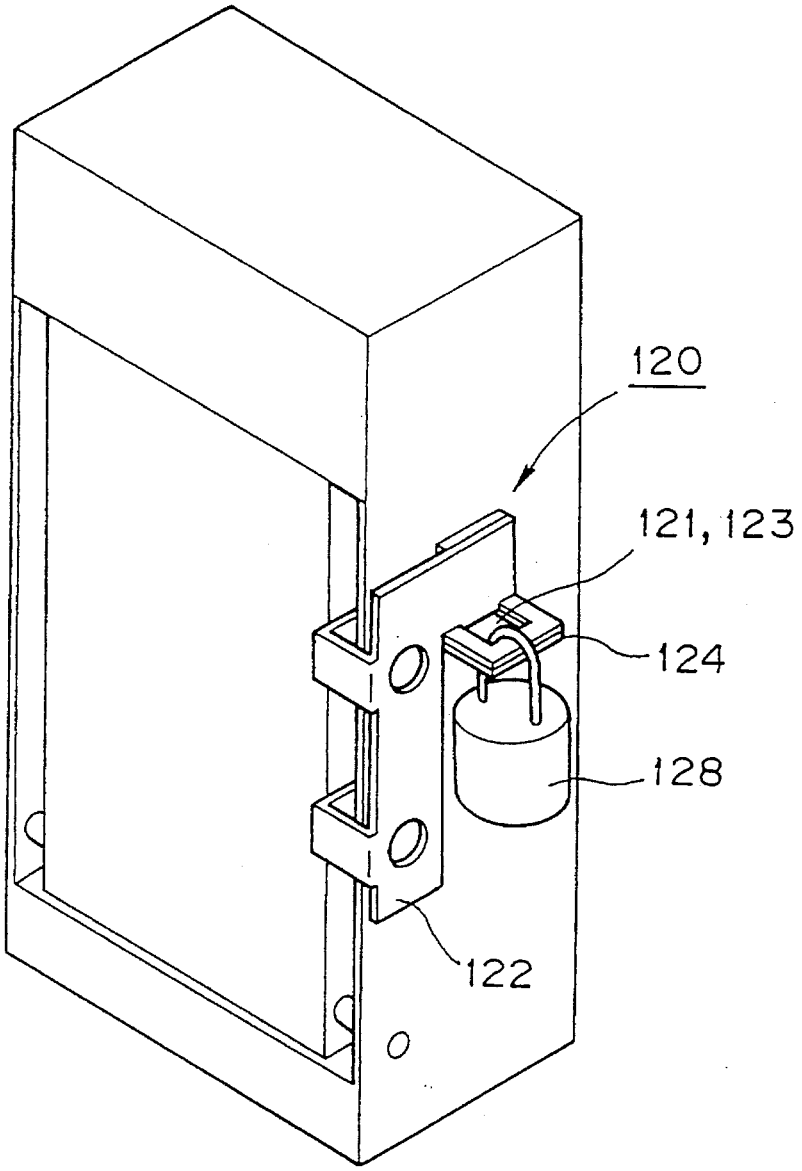
FIG. 31 is a perspective view of the bill processor for explaining the operation of the connection means.

When the stacker 28 is mounted to the main body 25 from such a state that the stacker 28 is in its open state as shown in FIG. 30, the arm 122 is overlapped with the arm receiver 124 so that the respective openings 121 and 123 are substantially aligned with each other as shown in FIG. 31. When the money collecting person sets a lock 128 in such a manner that the lock 128 is passed through the openings 121 and 123, the top of the stacker 28 cannot be opened from the main body 25. In other words, even when an unauthorized person succeeded to illegally open the door of the main body, the top of the stacker 28 cannot be opened so long as the unauthorized person does not succeed to unlock the lock 128 engaged to the connection means 120, thus preventing illegal taking-out of from the vending machine.

In the connection means 120 used in the present embodiment, when the stacker 28 is mounted to the main body 25 as shown in FIG. 31, the two holes 125 formed in the arm 122 are covered with the side surface of the main body 25 and the screw 127 of the arm receiver 124 is also shielded by one end of the arm 122 covering the screw 127, dismounting of the connection means 120 itself can be prevented.

The mounting location of the connection means 120 can be suitably selected so long as the connection means 120 located at the mounting position will not hinder the bill collection, maintenance, inspection, etc. of the money collecting person. Further, the shape, location, etc. of the arm, arm receiver and respective holes and openings may be suitably selected as necessary. A plurality of the connection means 120 may be provided as necessary. In addition, the lock 128 may be replaced by such a mechanical type of lock that can be unlocked with use of a key or with use of a combination of numbers or by such an electronic type of lock that can be unlocked with the input of a secret set number or with a magnetic card inserted thereinto.

In this manner, in using the connection means 120 having such a structure as mentioned above, when the money collecting person locks the lock 128 by passing it through the openings 121 and 123 with the stacker 28 mounted in the main body 25, the top of the stacker 28 cannot be opened from the main body 25. Thus, even when the door of the main body of the bill handling machine is illegally opened, the taking-out of from the stacker 28 can be prevented by the lock 128.

Figure 32:
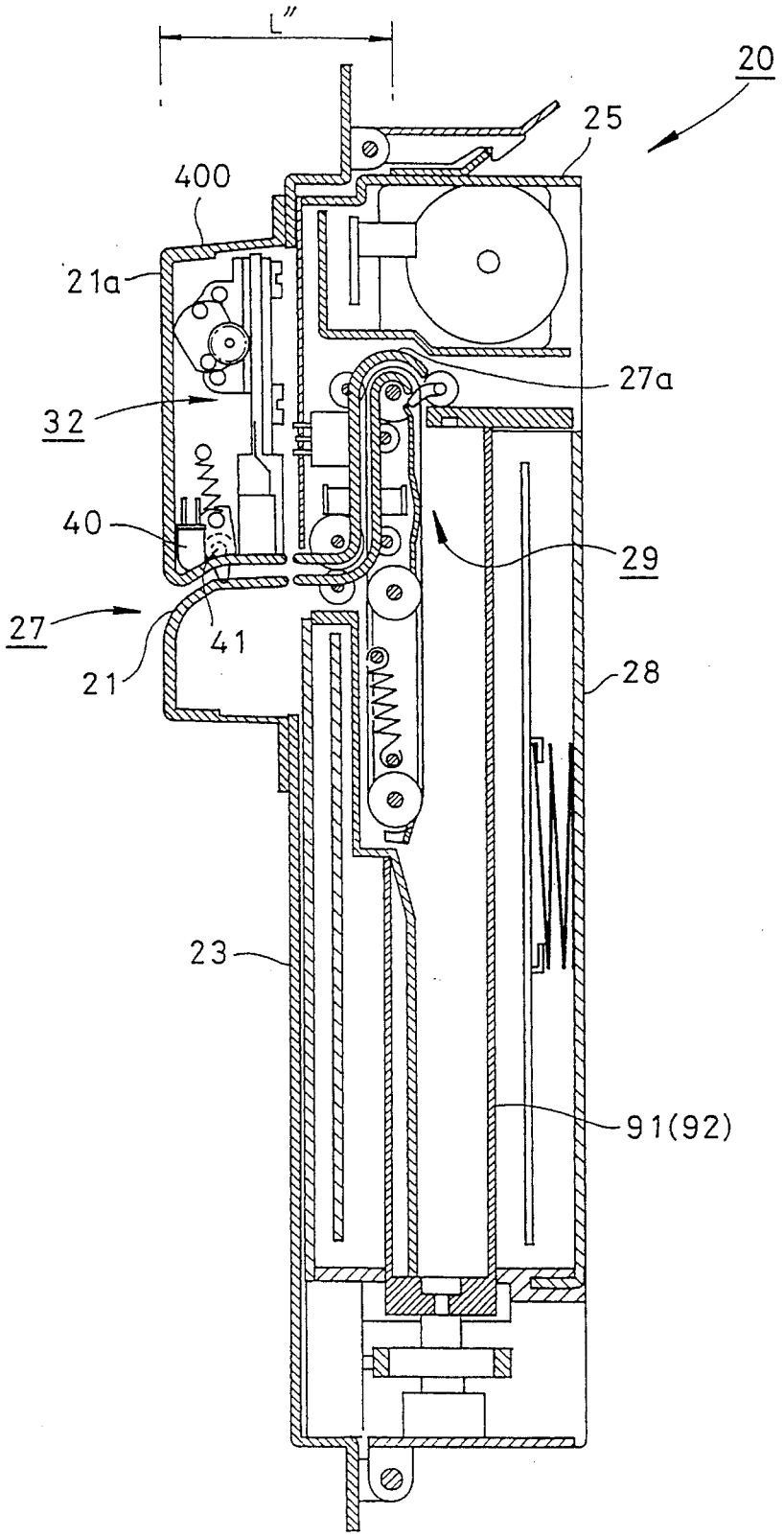
FIG. 32 is a cross-sectional view of a bill processor in accordance with another embodiment of the present invention.
Figure 33:
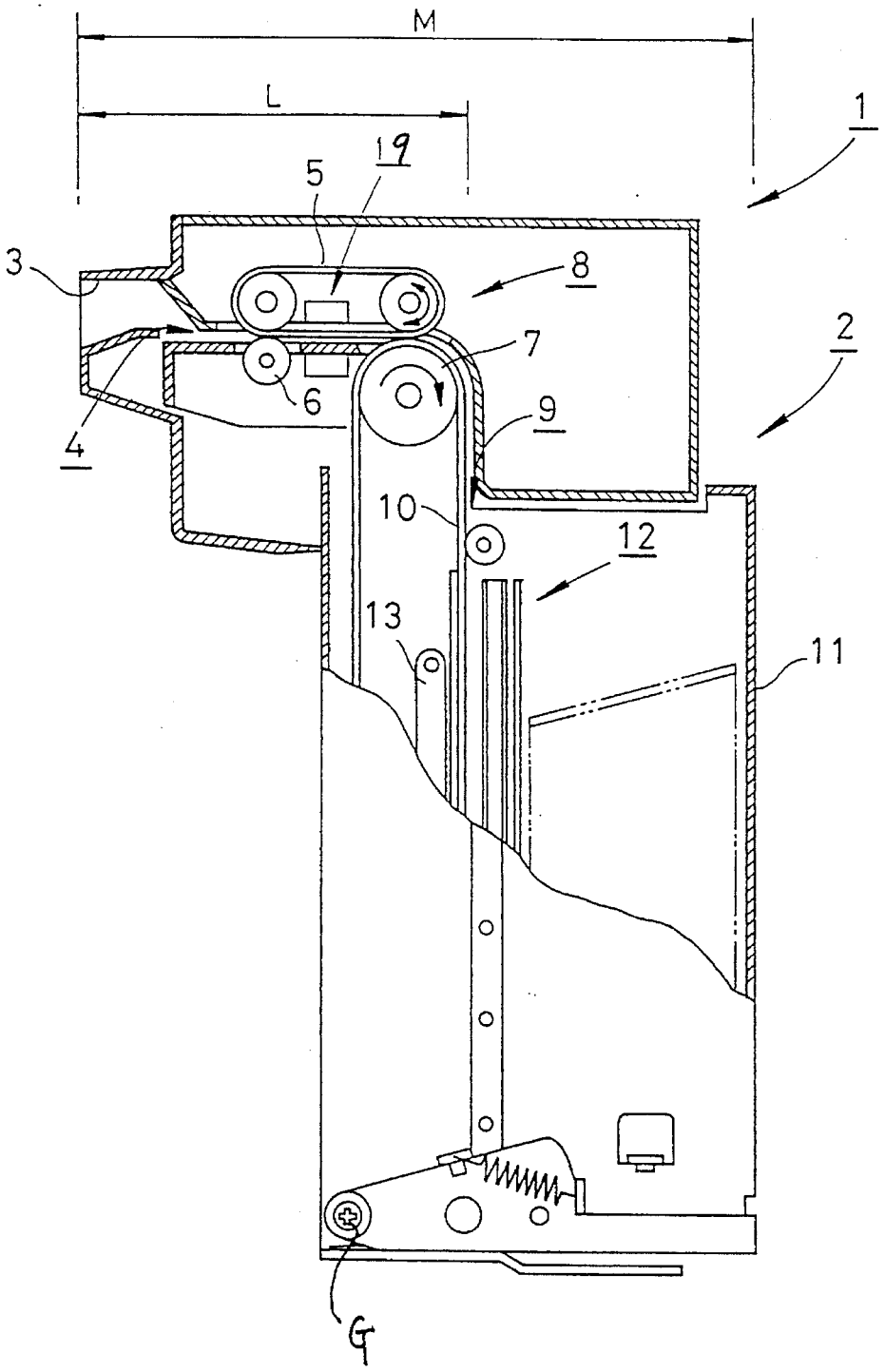
FIG.33 (PRIOR ART)
FIG. 33 is a cross-sectional view of a conventional bill processor.
Figure 34:
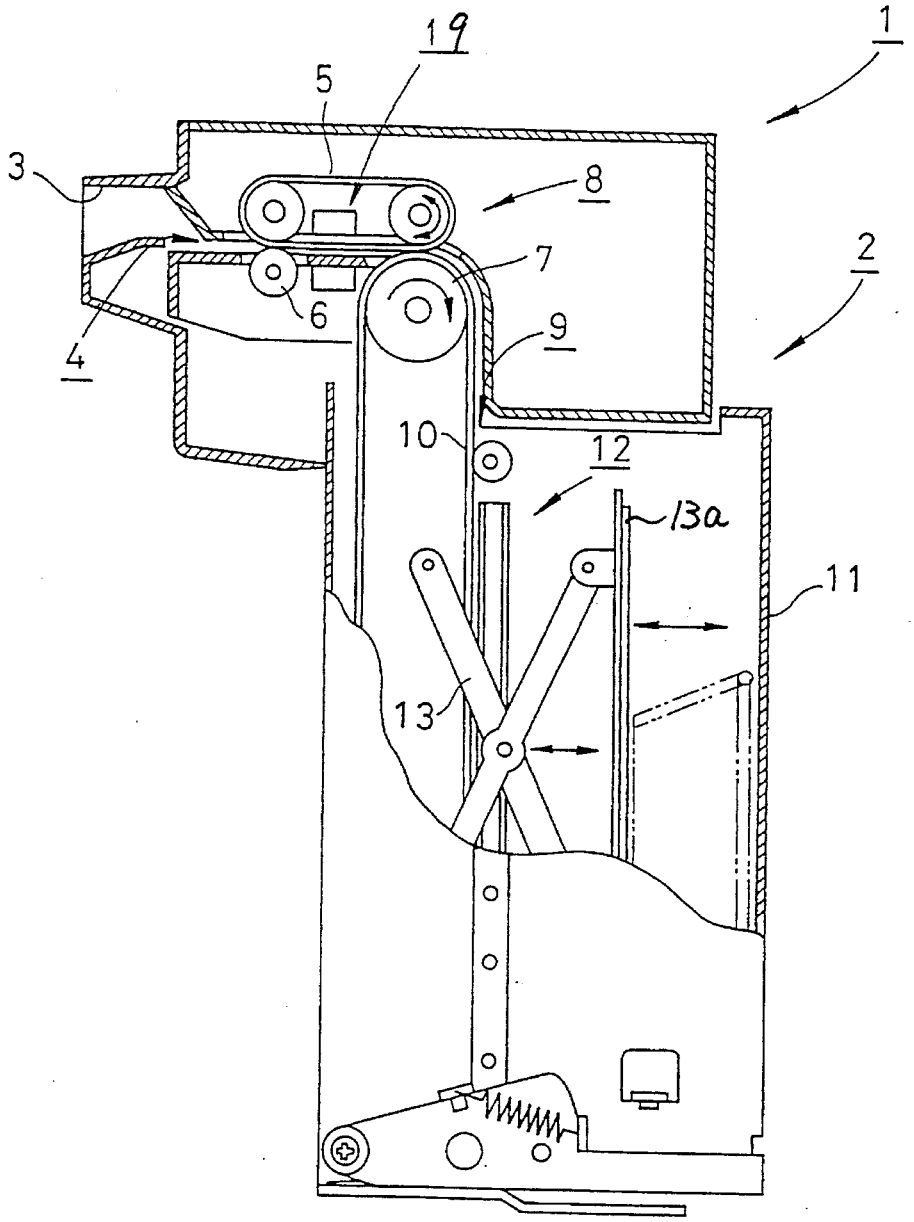
FIG.34 (PRIOR ART)
FIG. 34 is a cross-sectional view of the conventional bill processor for explaining the operation of the conventional processor.
Figure 35:
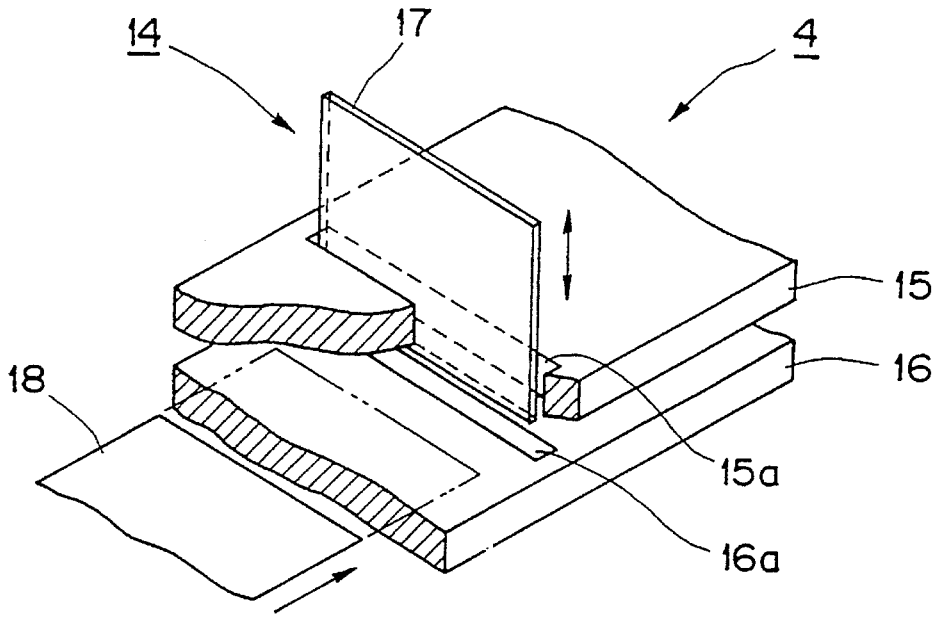
FIG.35 (PRIOR ART)
FIG. 35 is a partially broken-away perspective view of a structure of a shutter of the conventional bill processor.
Figure 36:
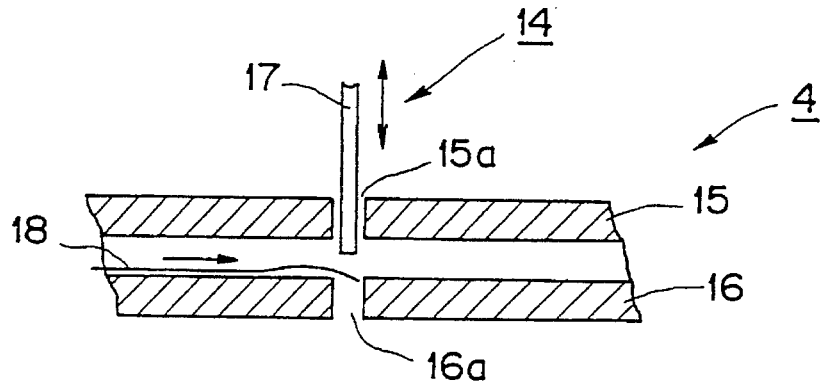
FIG.36 (PRIOR ART)
FIG. 36 is a cross-sectional view of a major part of the structure of the shutter in the conventional bill processor.

Although the first bill transport means 31 has been provided in the front mask 22 as shown in FIG. 1, the present invention is not limited to the specific example. For example, as in the bill processor 20 of FIG. 32 showing the components having the same reference numerals as those of FIG. 1, the first bill transport means 31 can be omitted from the interior of a front mask 400 and the first bill transport passage 27 can be formed to have a substantially L shape in a zigzag form. With such an arrangement, a depth L''' (L''<L') from the tip end 21*a* of the bill insert slot 21 to the start end (termination end 27*a* of the first bill transport passage 27) of the second bill transport passage 29 can be further shortened and therefore the dimension of the bill processor 20 in its depth direction can be made further small.

As has been described in the foregoing, in accordance with the bill processor 20, since the first bill transport passage for guiding the bill inserted through the bill insert slot immediately in the main body is formed in a zigzag form along the longitudinal direction of the bills stacked in the stacker, the distance of the first bill transport passage in the depth direction from the bill insert slot to the start end of the second bill transport passage can be made short and thus the dimension of the bill processor in the depth direction can be made small. In addition, since it is unnecessary to shorten the length of the first bill transport passage, various sorts of devices including a bill judging device can be provided therebetween side by side. As a result, the dimension of the bill processor in the depth direction can be made as small as possible while avoiding deterioration of the function of the bill processor.

The present invention can be modified in various ways without departing from the spirit and subject matter of the invention. Therefore, it should be appreciated that the foregoing embodiments are given merely as examples in any respects and the invention is not restricted to the specific embodiments. In other words, the scope of the present invention is not defined by the body of the specification but defined by the accompanying claims, i.e., includes all modifications and alternations belonging to the equivalent range of the claims.

What is claimed is:

1. A bill processor comprising:

a bill transport passage for guiding an inserted bill into a stacker in a main body of the bill processor;

a pair of bill guide drums rotatably provided along both sides of a down-stream portion of the bill transport passage, the bill guide drums having respective grooves along the axial direction thereof for inserting thereinto side edges of the inserted bill transported though the bill transport passage so that rotation of the pair of bill guide drums in opposite directions moves the inserted bill toward the stacker, and the bill guide drums further having respective notches along the circumferential direction thereof;

drive means for synchronously rotating the pair of bill guide drums in the opposite directions; and a bill pushing plate provided in a space between the pair of bill guide drums, one end thereof being rotatably supported and another end thereof being engaged with the notches formed in the pair of bill guide drums so that rotation of the pair of bill guide drums in the opposite directions rotates the bill pushing plate around the one end thereof by means of the notches to push the inserted bill toward the stacker.

2. A bill processor as set forth in claim 1, further comprising:

first connection means provided on a side of the stacker and formed with an opening of a predetermined shape; and second connection means provided at the main body of the bill processor and formed with an opening of the predetermined shape so as to communicate with the opening of the first connection means when the stacker is mounted to the main body, wherein the stacker is prevented from being released from the main body by means of a lock passed through the openings of the first and the second connection means.

3. A bill processor as set forth in claim 1, further comprising stacker-full detection means for detecting that the stacker is fully stacked with bills on the basis of a load output of the drive means when the bill pushing plate pushes the bills toward the stacker.

4. A bill processor as set forth in claim 3, wherein the drive means comprises a motor for synchronously rotating the pair of bill guide drums, and the stacker-full detection means comprises:

means for measuring the load output of the motor generated when the motor is operated;

judgement means for judging whether or not the load output measured by the measurement means exceeds a set value; and means for outputting a stacker-full detection signal to an external monitor device according to a judgement result of the judgement means.

5. A bill processor comprising:

a bill transport passage for guiding an inserted bill in a main body of the bill processor; and a stacker for stacking therein the bill transported through the bill transport passage, wherein bill restraint means are provided at both sides of the stacker for partly restraining bills stacked in the stacker at both sides of the bills when the stacker is released from the main body and for releasing the restraint of the bills stacked in the stacker when the stacker is mounted to the main body.

6. A bill processor as set forth in claim 5, wherein the bill restraint means include levers of a substantially L shape pivotably supported on a shaft, the levers are rotated around the shaft to move out of a top surface of the stacker when the stacker is mounted to the main body, and the levers are rotated around the shaft to move into the top surface of the stacker and to partly restrain the bills stacked in the stacker at both sides of the bills when the stacker is released from the main body.

7. A bill processor as set forth in claim 5, further comprising:

first connection means provided on a side of the stacker and formed with an opening of a predetermined shape; and second connection means provided at the main body of the bill processor and formed with an opening of the predetermined shape so as to communicate with the opening of the first connection means when the stacker is mounted to the main body, wherein the stacker is prevented from being released from the main body by means of a lock passed through the openings of the first and the second connection means.

* * * * *